US007697022B2

(12) United States Patent
Gomi

(10) Patent No.: US 7,697,022 B2
(45) Date of Patent: Apr. 13, 2010

(54) ELECTRO-OPTICAL DEVICE AND IMAGE FORMING APPARATUS

(75) Inventor: Tsugio Gomi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/848,949

(22) Filed: Aug. 31, 2007

(65) Prior Publication Data

US 2008/0080897 A1 Apr. 3, 2008

(30) Foreign Application Priority Data

Sep. 29, 2006 (JP) ..... 2006-266420
Dec. 20, 2006 (JP) ..... 2006-342296
Mar. 28, 2007 (JP) ..... 2007-083691

(51) Int. Cl.
*B41J 2/45* (2006.01)
*B41J 15/14* (2006.01)
*G03G 15/04* (2006.01)

(52) U.S. Cl. ..... 347/241; 347/238; 399/220; 399/221

(58) Field of Classification Search ..... None
See application file for complete search history.

(56) References Cited

U.S. PATENT DOCUMENTS

| | | | | |
|---|---|---|---|---|
| 7,061,518 | B2 | 6/2006 | Ueda et al. | |
| 7,074,847 | B2 * | 7/2006 | Doi et al. | 524/130 |
| 2005/0110128 | A1 * | 5/2005 | Ahn et al. | 257/686 |
| 2006/0152652 | A1 * | 7/2006 | Uematsu | 349/95 |

FOREIGN PATENT DOCUMENTS

| | | |
|---|---|---|
| JP | A-62-211972 | 9/1987 |
| JP | A-61-233567 | 10/1988 |
| JP | A-2-117863 | 5/1990 |
| JP | A-3-231561 | 10/1991 |
| JP | A-3-250810 | 11/1991 |
| JP | A-9-226167 | 9/1997 |
| JP | A-2001-26139 | 1/2001 |
| JP | A-2002-151249 | 5/2002 |
| JP | A-2002-232019 | 8/2002 |
| JP | A-2006-51622 | 2/2006 |
| JP | A 2006-205430 | 8/2006 |
| JP | A 2006-218848 | 8/2006 |
| JP | A 2006-289721 | 10/2006 |
| WO | WO 02/092349 A1 | 11/2002 |

* cited by examiner

*Primary Examiner*—Matthew Luu
*Assistant Examiner*—Kendrick X Liu
(74) *Attorney, Agent, or Firm*—Oliff & Berridge, PLC

(57) ABSTRACT

An electro-optical device includes a light source array having a plurality of light-emitting devices arranged on a substrate in a direction, a lens array having a plurality of lens elements arranged in the direction, each lens element forming an image on an image carrier using light from the light-emitting element, and a first light transmissible member and a second light transmissible member disposed between the light source array and the lens array so as to be in contact with the light source array and the lens array, in which the first light transmissible member and the second light transmissible member are arranged in continued manner in the direction, and wherein the first light transmissible member and the second light transmissible member are different in any one or more characteristics of refractive index, elastic modulus and light transmittance.

4 Claims, 17 Drawing Sheets

ELECTRO-OPTICAL DEVICE AND IMAGE FORMING APPARATUS

BACKGROUND

1. Technical Field

The present invention relates to an electro-optical device including an electro-optical panel in which a plurality of electro-optical elements, such as electro-luminescent elements (EL) or a plurality of light valves is arranged, an image forming apparatus using the electro-optical device, and a method of manufacturing the electro-optical device.

2. Related Art

As for a line-printer head which records an electrostatic latent image on an image carrier, for example a photoconductor drum of an elect-photographic image forming apparatus, techniques using an electroluminescent element (EL) array has been developed. JP-A-2006-205430 discloses one of such techniques, in which a converging lens array is disposed between an EL element array and an image carrier. A well-known converging lens array is a SELFOC lens array ("SELFOC" is a trademark) available from Nippon Sheet Glass Co., Ltd. In the converging lens array, each refractive index distribution type lens is constituted by a graded index optical fiber having a graded refractive index profile in which the refractive index is the lowest at a central axis thereof and becomes higher as it becomes farther from the central axis. The converging lens array allows light from an EL element array to pass therethrough so that an erect image with respect to an image on the EL element array can be imaged on the image carrier. The image imaged on the image carrier by using a plurality of refractive index distribution type lenses constitutes a single continuous image.

JP-A-2006-218848 discloses a technique in which a light transmissible spacer is arranged between an EL element array and a converging lens array in order to reduce loss of light from EL elements. With such a structure, a diameter of light beam emitted from the EL elements and advancing toward the lens array is smaller than that in a structure with no spacer but air between a light source array and a lens array. Accordingly, it is possible to increase the ratio (the efficiency of light utilization) of quantity of light from the light source array to quantity of light incident on the lens array.

As for the printer head, it is desirable that the optical characteristics of spots of the image carrier on which light from the EL elements is irradiated is even when the plurality of EL elements emits light. That is, a spot irradiated by light from a certain EL element and a spot irradiated by light from another EL element preferably have almost the same optical characteristics.

SUMMARY

An advantage of some aspects of the invention is that it provides an electro-optical device capable of improving uniformity of optical characteristics on spots of an image carrier which are irradiated by light from electro-optical elements over the overall area of the image carrier when the electro-optical elements are driven, an image forming apparatus using the electro-optical device, and a method of manufacturing the electro-optical device.

BRIEF DESCRIPTION OF THE DRAWINGS

The invention will be described with reference to the accompanying drawings, wherein like numbers reference light elements.

DESCRIPTION OF EXEMPLARY EMBODIMENTS

Hereinafter, embodiments of the invention will be described with reference to the accompanying drawings, in which elements in each drawing is not illustrated in an actual scale but illustrated in properly adjusted scales.

First Embodiment

Figure 1:
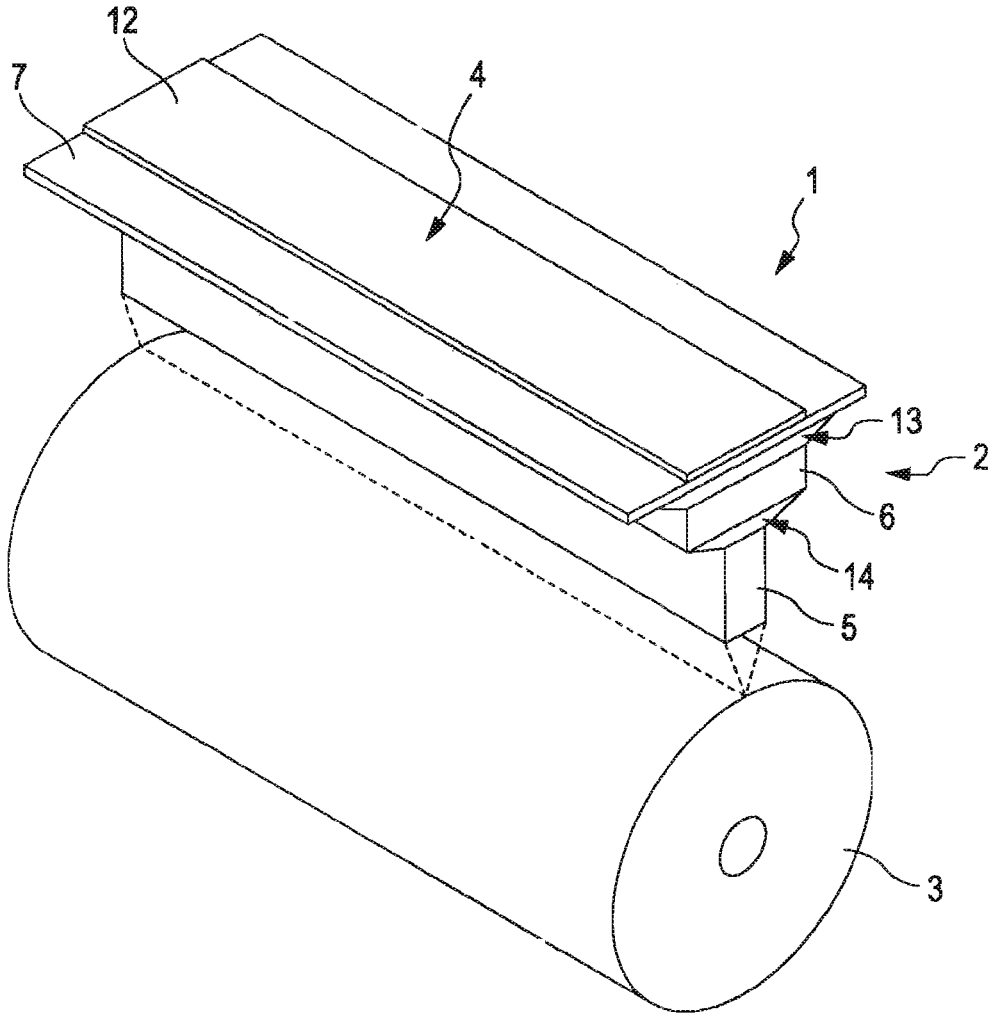
FIG. 1 is a perspective view illustrating part of a printer according to a first embodiment.

FIG. 1 shows part of an electro-photographic printer 1 which is an image forming apparatus using a printer head 2 (electro-optical device) according to a first embodiment.

As shown in FIG. 1 the printer 1 includes the printer head 2 and a photoconductor drum 3 serving as an image carrier. The photoconductor drum 3 rotates in a state in which it is supported by a rotational shaft which runs in a direction parallel to the lengthwise direction of the printer head 2 and having an outer circumferential surface facing the printer header 2. The printer head 2 functions as an exposure device of the printer head 2.

The printer head 2 includes a light source array 4 having a rectangular shape and including a plurality of light-emitting elements arranged on a substrate, a lens array 5 including a plurality of lens elements aligned so as to form an one-to-one magnification erect image on a photoconductor drum 3 using light from the light source array 4, and a spacer member 6 interposed between the light source array 4 and the lens array 5.

Figure 2:
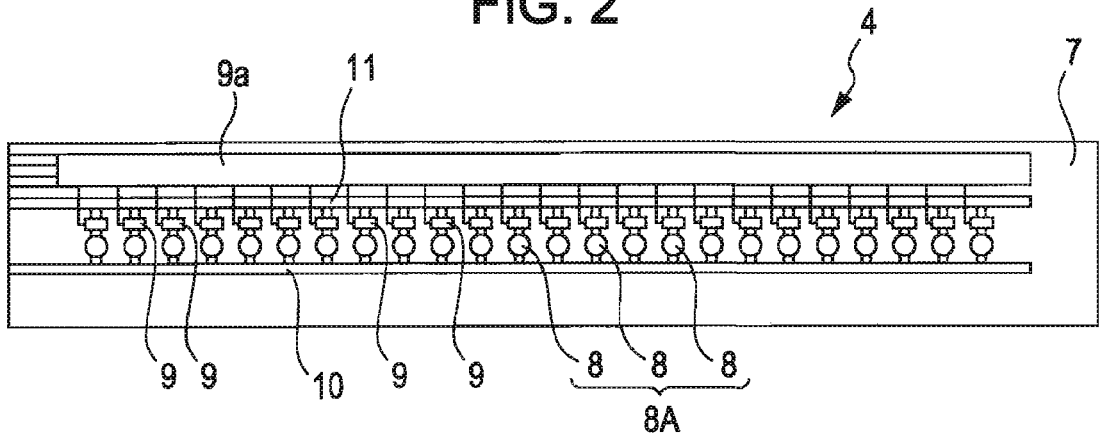
FIG. 2 is a plan view schematically illustrating a light source array according to the first embodiment.

FIG. 2 schematically shows the light source array 4. To constitute the light source array 4, a light-emitting element column 8A, a driving element group and a control circuit 9*a* are arranged on an element substrate 7 in an integrated manner. The element substrate 7 is a main component having a rectangular shape and made of glass with high purity. The light-emitting element column 8A includes a plurality of organic electroluminescent (EL) elements, which are light-emitting elements. The driving element group includes a plurality of driving elements 9 which drives the organic EL elements 8. The control circuit 9*a* controls operation of the driving element group. In FIG. 2, the organic EL elements 8 are arranged in a single column but alternatively may be arranged in two columns in a zigzag form. When the organic EL elements 8 are arranged in the zigzag form, the organic EL elements can be arranged at a smaller pitch in the lengthwise direction of the light source array 4, and thus resolution of the printer can be enhanced.

The organic EL element 8 is structured in a manner such that at least an organic light-emitting layer is interposed between a pair of electrodes and emits light when current is supplied to the light-emitting layer from the electrodes.

In the organic EL element 8, one electrode of the pair of electrodes is connected to a common line 10 and the other electrode is connected to a data line 11 via the driving element 9. The driving element 9 is constituted by a switching element, such as a thin film transistor (TFT), a thin film diode (TFD), or the like. In the case of using the TFT as the driving element 9, the TFT is connected to the data line 11 at its source region and to the control circuit group 9*a* at its gate electrode. Thus, the driving element 9 is controlled by the control circuit group 9 so as to allow current from the data line 11 to flow to the organic EL element 8.

At a region of the element substrate 7 on which the organic EL elements 8 are aligned and arranged, a sealing member 12 is joined to the element substrate 7 in order to seal the organic EL elements 8. The sealing member 12 has a rectangular plate form and seals the organic EL elements 8 so as to block air intrusion to the organic EL elements by cooperating with the element substrate 7. The sealing member 12 is disposed in a manner such that the long side of the sealing member 12 and the long side of the element substrate 7 are arranged in the same direction. This structure suppresses degradation of the organic EL element 8, which is attributable to air or moisture attachment thereto. Further, the control circuit 9*a* is mounted on the element substrate 7 at a region uncovered by the sealing member 12.

The light source array 4 having the above-mentioned structure is a bottom emission type light source array in which the element substrate 7 directs downward (see FIG. 1). The linear expansion coefficient (ratio of length change to temperature change) of the element substrate 7 which is a main component of the light source array is about $3.8\times10^{-6}/^{\circ}$ C.

Figure 3:
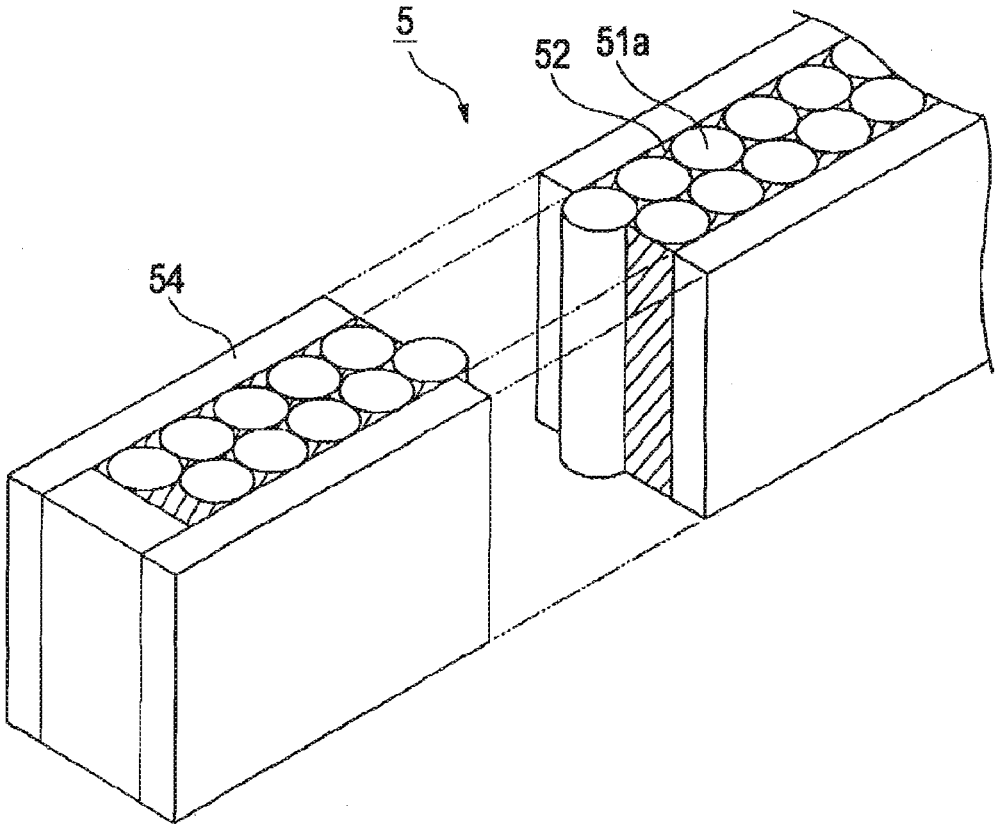
FIG. 3 is a perspective view illustrating a lens array according to the first embodiment.

FIG. 3 shows the lens array 5 in a perspective view. In the lens array 5, a plurality of SELFOC™ lens elements 51*a* available from Nihon Sheet Glass Co., Ltd. is arranged. The lens element 51*a* has a fiber form having a diameter of 0.28 mm. The lens elements 51*a* are arranged in a zigzag form so as to form a cluster and each gap between the lens elements 51*a* is filled with black silicon resin 52. A frame 54 surrounds the cluster of the lens elements 51*a*.

The lens element 51*a* has a refractive index distribution profile distributed in a radial direction over a way from the center to the edge thereof. Accordingly, light impinging to the lens element 51*a* advances meandering at regular intervals. The one-to-one magnification erect image can be obtained by adjusting the length of the lens element 51*a*. Thus, by using the one-to-one magnification erect image forming lens, it is possible to overlap images produced by adjacent lenses, so that an image taken over a large area can be obtained. Accordingly, the lens array 5 shown in FIG. 3 is structured in a manner such that it can image with high precision using light from the whole light source array. In addition, linear expansion coefficient of the lens array 5 is about $1.0\times10^{-5}/^{\circ}$ C.

In FIG. 1, the spacer member 6 is made of a light transmissible material, such as glass or plastic. The spacer member 6 has an almost circular section when it is taken in a direction perpendicular to the lengthwise direction. The length (in the lengthwise direction) of the spacer member 6 is shorter than the length (in the lengthwise direction) of the light source array 4 but longer than the length (in the lengthwise direction) of the lens array 5. Further, the length (in the widthwise direction) of the spacer member 6 is shorter than the length (in the widthwise direction) of the light source array 4 but longer than the length (in the widthwise direction) of the lens array 5. In the section of the spacer member 6, which is perpendicular to the lengthwise direction of the spacer member 6, the length in the widthwise direction (up-to-down direction in FIG. 1) is shorter than the length in the lengthwise direction. The linear expansion coefficient of the spacer member is about $9.4\times10^{-6}/^{\circ}$ C.

As shown in FIG. 1, the light source array 4, the lens array 5, and the spacer member 6 structured above are integrated to form the printer head 2 in a manner such that the spacer member 6 is joined to the element substrate 7 of the light source array 4 using a light transmissible adhesive 13, and the lens array 5 is joined to the spacer member 6 using a light transmissible adhesive 14. The overall size of the printer head 2 is about 230 to 240 mm long for a paper sheet of A4 size or about 320 to 330 mm long for a paper sheet of A3 size.

Figure 4:
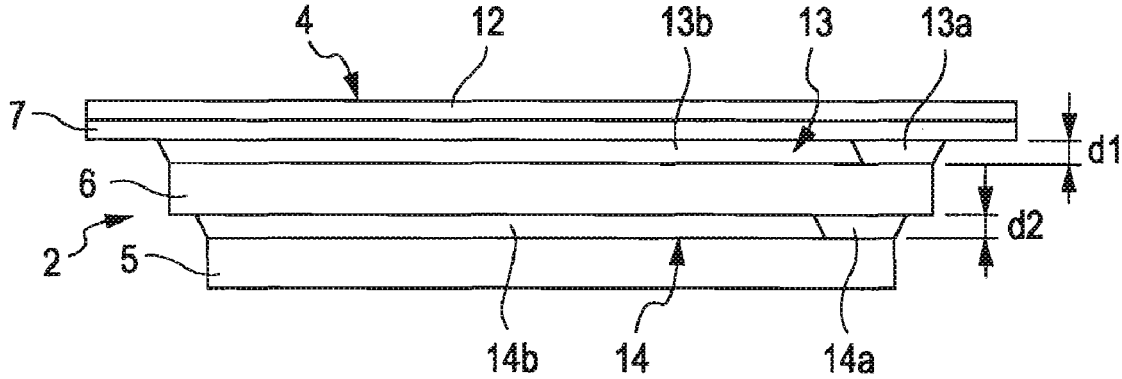
FIG. 4 is a side view illustrating a printer head which is an example of an electro-optical device according to the first embodiment.

FIG. 4 shows the printer head 2 in a side view. As shown in FIG. 4, the adhesive 13 is composed of two kinds of adhesive including a first adhesive 13*a* and a second adhesive 13*b*, and the adhesive 14 is composed of two kinds of adhesive including a first adhesive 14*a* and a second adhesive 14*b*.

The first adhesives 13*a* and 14*a* are coated on the element substrate 7 of the light source array 4, the lens array 5, and the spacer member 6 at respective one end portions (right side end portions in FIG. 4) thereof, i.e. over the whole length in the widthwise direction of the printer head 2.

The first adhesives 13*a* and 14*a* are a thermoset adhesive or an ultraviolet (UV) cure adhesive. In greater detail, the first adhesives 13*a* and 14*a* include Optodyne UV-3200™ which is manufactured by Daikin Industries, Ltd and which is a UV cure epoxy-based adhesive having light transmittance of 90% or more with a thickness of 0.1 mm and a refractive index of 1.514 almost the same as that of glass after curing, Optocrave HV153™ which is manufactured by Adell Corp. and which is a UV cure epoxy-based adhesive having a refractive index of 1.63 higher than that of glass after curing, and Optodyne UV-4000™ which is manufactured by Daikin Industries, Ltd and which is a UV cure epoxy-based adhesive having a refractive index of 1.567 after curing. However, the first adhesives 13*a* and 14*a* are not limited thereto.

The light source array 4 and the spacer member 6 are jointed to each other while being spaced apart from each other with a predetermined gap therebetween by the first adhesive 13*a*. The spacer member 6 and the lens array 5 are joined to each other while being spaced apart from each other with a predetermined gap therebetween by the first adhesive 14*a*. The distance (gap size) d1 between the element substrate 7 of the light source array 4 and the spacer member 6, and the distance (gap size) d2 between the spacer member 6 and the lens array 5 is about 10 μm.

The second adhesives 13*b* and 14*b* are applied to the light source array 4, the lens array 6 and the spacer member 6 at positions in which the first adhesives 13*a* and 14*a* are not provided. Area of each second adhesive 13*b* and 14*b* is set to be larger than that of each first adhesive 13*a* and 14*a*.

The second adhesives 13*b* and 14*b* are an adhesive having a gel-state composition or a rubber-state composition having elastic modulus lower than that of the first adhesives 13*a* and 14*a*. Further, the second adhesives 13*b* and 14*b* have almost the same refractive index and light transmittance as the first adhesives 13*a* and 14*a*.

The function of the adhesives 13 and 14 of the printer head 2 structured in the above-mentioned manner will be described below.

Figure 5:
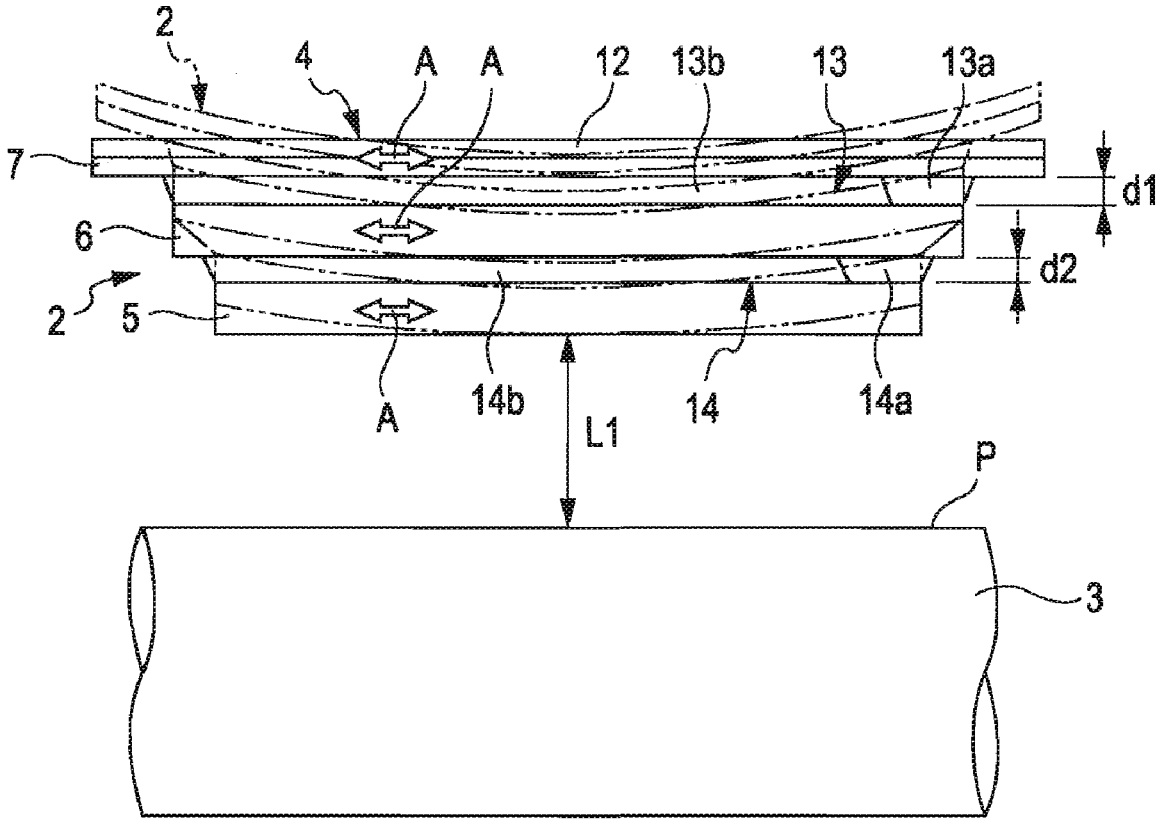
FIG. 5 is a side view illustrating part of a printer according to the first embodiment.

FIG. 5 shows part of a printer 1 in a side view. As shown in FIG. 5, in the printer head 2, the light source array 4, the leans array 5, and the spacer member 6 expand when temperature rises due to heat from the organic EL elements 8 or from peripheral devices (not shown). The light source array 4, the leans array 5, and the spacer member 6 have different expansion coefficients, and hereinafter, the case in which a linear expansion coefficient of the spacer member 6 is higher than that of the light source array 4 as in the first embodiment will be described. Accordingly, geometry variation (expansion variation, for example, a degree of expansion in a direction of an arrow A changes according to temperature, as shown in FIG. 5) causes distortion of the printer head 2, so that the printer head 2 tends to bend upward in an arc-form in a manner such that both ends of the printer head 2 in the lengthwise direction separate from the photoconductor drum 3 while going upward (see, dashed-two dotted line in FIG. 5) If the printer head 2 is distorted in an arc form, a distance L1 between the photoconductor drum 3 and the lens array 5 becomes larger as it becomes farther from the center of the printer head 2 toward both ends of the printer head 2 in the lengthwise direction (displacement of lens array). As a result, an actual imaging position is displaced in an optical axis direction with respect to a position P (reference imaging position) on the surface of the photoconductor drum 3, and thus optical characteristics at the reference imaging position are deteriorated. That is, an image becomes blurred.

However, according to the first embodiment, the second adhesives 13*b* and 14*b* made of a gel-state composition or a rubber-state composition having a relatively low elastic modulus are applied over a relatively large area of the printer head 2. Accordingly, the elastic deformation of the second adhesives 13*b* and 14*b* offsets distortion of the printer head 2 which is attributable to the difference among thermal expansion coefficients of the light source array 4, the spacer member 6, and the lens array 6. This prevents the printer head 2 from bending like a bow.

According to the above-described first embodiment, it is possible to maintain the distance L1 between the surface of the photoconductor drum 3 and the surface of the lens array 5 which faces the photoconductor drum 3 constant over the entire length of the lens array 5 because the printer head 2 does not bend upward even at high temperatures. Moreover, the first adhesives 13*a* and 14*a* function as a gap securing adhesive which maintains the distance between the element substrate 7 of the light source array 4 and the spacer member 6 and the distance between the space member 6 and the lens array 5 at a constant value. Accordingly, even if the second adhesives 13*b* and 14*b* are elastically deformed, such elastic deformation does not affect the printer head 2. As a results, it is possible to prevent images formed on the photoconductor 3 from deteriorating in optical characteristics.

The spacer member 6 is generally made of glass or plastic and the lens array 5 is generally made of softer glass than a material for the spacer member 6. Accordingly, elastic modulus of the lens array 5 is lower than that of the spacer member 6. For this reason, the first adhesive 14*a* may replace the second adhesive 14*b* to join the spacer member 6 and the lens array 5 to each other. In this case, the lens array 6 absorbs thermal distortion attributable to the difference of thermal expansion coefficients of the spacer member 6 and the lens array 5 so as to suppress the arc-shaped bending of the printer head 2.

It is known that the deformation (bending upward) of the printer head 2 greatly attributes to the strengths of components including the light source array 4, the lens array 5 and the spacer member 6. For this reason, even though that the spacer member 6 and the lens array 5 can be sufficiently joined to each other by only the first adhesive 14*a*, the light source array 4 and the spacer member 6 must not be joined by only the first adhesive 14*a* due to the following reason. Thermal expansion coefficients of the light source array 4 and the spacer member 6 are different from each other, distortion greatly affects the joint of elements having high strength, and the joint by use of only the first adhesive 14*a* for the elements having the high strength easily results in deformation (bending upward deformation).

Figure 6:
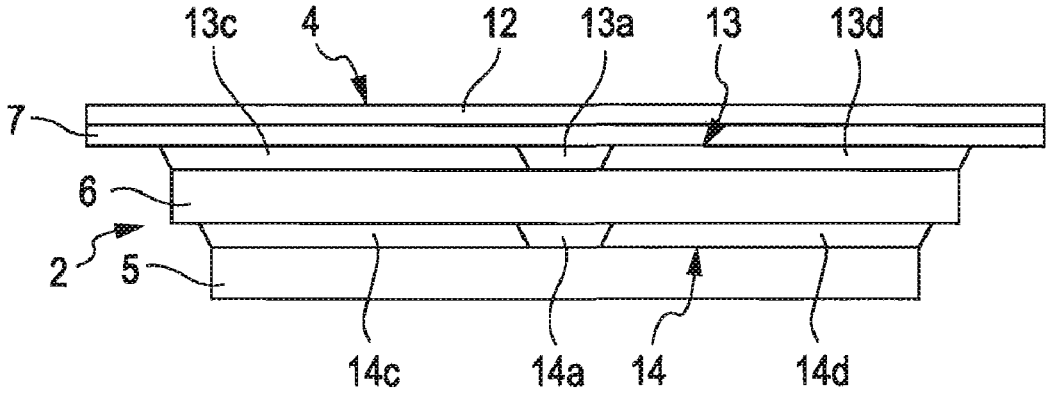
FIG. 6 is a side view illustrating part of the printer head serving as the electro-optical device according to the first embodiment.

According to the first embodiment, the first adhesives 13*a* and 14*a* are applied to one end portions of the element substrate 7 of the light source array 4, the lens array 5, and the spacer member 6 (see FIG. 4). However, as shown in FIG. 6, the first adhesives 13*a* and 14*a* may be present on the joint surfaces of the element substrate 7 of the light source array 4, the lens array 5, and the spacer member 6 at respective middle portions (in the lengthwise direction) thereof over the overall length (in the widthwise direction) of the printer head 2. The other portions of the joint surfaces of the element substrate 7 of the light source array 4, the lens array 5, and the spacer member 6 which are not covered with the first adhesives 13*a* and 14*a* are coated with second adhesives 13*c*, 13*d*, 14*c* and 14*d*.

According to this structure, it is possible to more securely maintain the distances d1 and d2 at a constant value and stably join the element substrate 7 of the light source array 4, the lens array 5, and the spacer member 6 to each other in comparison with the structure in which the first adhesives 13*a* and 14*a* are provided only at one end portions of the element substrate 7 of the light source array 4, the lens array 5, and the spacer member 6.

In this structure, the second adhesives 13*c*, 13*d*, 14*c*, and 14*d* are also made of a softer material than the first adhesives 13*a* and 14*a* like the second adhesives 13*b* and 14*b*, which has a gel-state composition or a rubber-state composition. Moreover, the second adhesives 13*c*, 13*c*, 14*c*, and 14*d* have the same refractive index and light transmittance as the first adhesives 13*a* and 14*a*.

In the second embodiment, alternatively, a liquid, for example, silicon oil which is not adhesive and is curable and has the same refractive index and light transmittance as the first adhesive 13*a* and 14*a* may be used instead of the second adhesives 13*b*, 14*b*, 13*c*, 13*d*, 14*c*, and 14*d*. In the case in which the liquid is injected into the gap between the element substrate 7 and the spacer member 6 and the gap between the spacer member 6 and the lens array 5, since the distances (gap sizes) d1 and d2 are about 10 μm, the liquid can be held in the gaps by surface tension and does not leak out from the printer head 2.

It is possible to effectively absorb elastic deformation of each component attributable to difference between thermal expansion coefficients by using the liquid instead of the second adhesives 13*b*, 14*b*, 13*c*, 13*d*, 14*c*, and 14*d*. Thus, it is possible to surely prevent optical characteristics of the images formed on the photoconductor drum 3 from being deteriorated.

Moreover, the use of liquid has another advantage of reducing manufacturing time because the components joint is achieved in a simple manner, for example by injecting the liquid into the gaps between the element substrate 7 and the spacer member 6 and between the spacer member 6 and the lens array 5 after by jointing the element substrate 7, the spacer member 6 and the lens array 5 to each other by using the first adhesives 13*a* and 14*a*.

Further, since the distances between the light source array 4 and the spacer member 6 and between the spacer member 6 and the lens array 5 are set by only applying the first adhesives 13*a* and 14*a* at some regions of the light source array 4, the lens array 5, and the spacer member 6, it is possible to omit the second adhesives 13*b*, 14*b*, 13*c*, 13*d*, 14*c*, and 14*d* in the printer head 2. However, the printer head 2 having such a structure is disadvantageous in that the positional relationship among components is unstable, and a ratio of quantity of light incident on the lens array 5 to quantity of light emitted from the light source array 4 is decreased due to presence of air in the gap between the light source array 4 and the lens array 5. That is, by the structure in which the second adhesives 13*b*, 14*b*, 13*c*, 13*d*, 14*c*, and 14*d* or the liquid is provided in the gaps between the joint surfaces at regions other than the regions provided with the first adhesives 13*a* and 14*a*, it is possible to make the positional relationship among the components stable and increase the ratio of the light quantity entering the lens array 5 to the light quantity from the light source array 4.

Second Embodiment

Hereinafter, a second embodiment will be described with reference to FIGS. 2, 3, 7 and 8. Like elements in the first embodiment and the second embodiment are referenced by like symbols.

In the second embodiment, a printer 31 basically has the same structure as the printer 2, for example the printer 31 includes a printer head 31 and a photoconductor drum 3.

Figure 7:
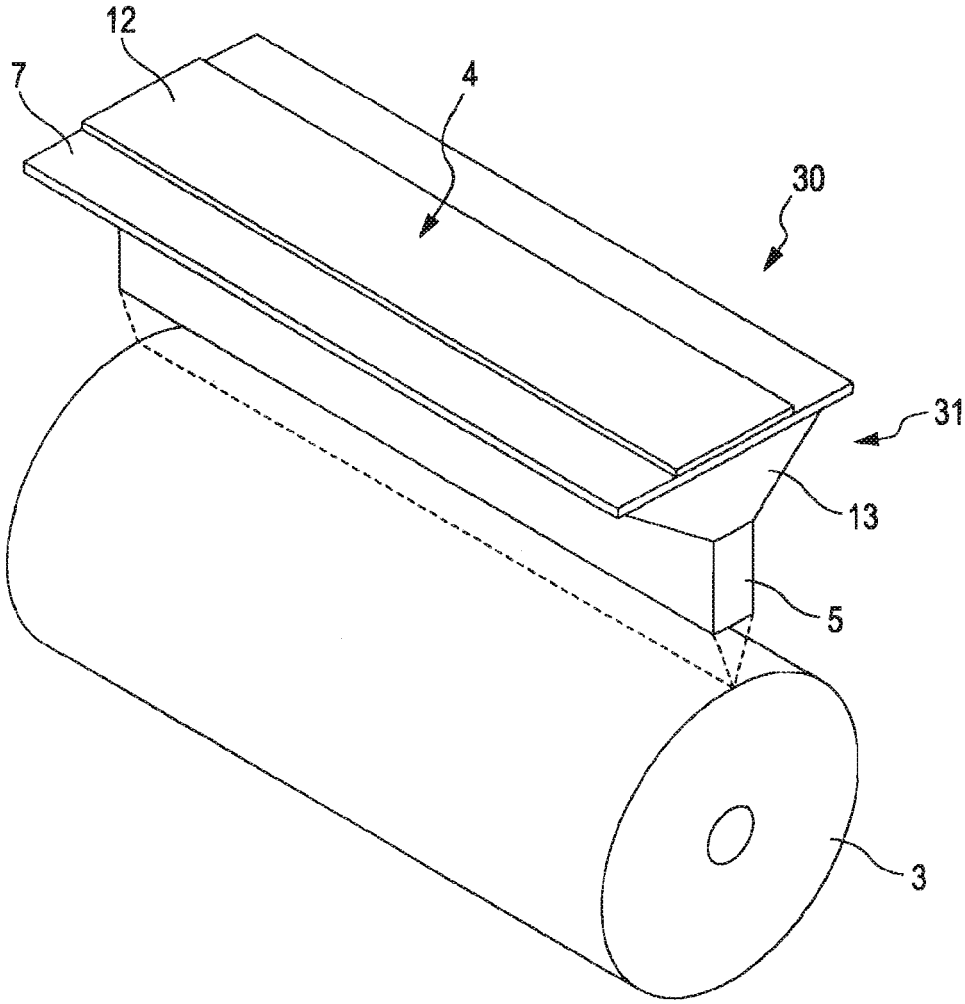
FIG. 7 is a perspective view illustrating part of a printer according to a second embodiment.
Figure 8:
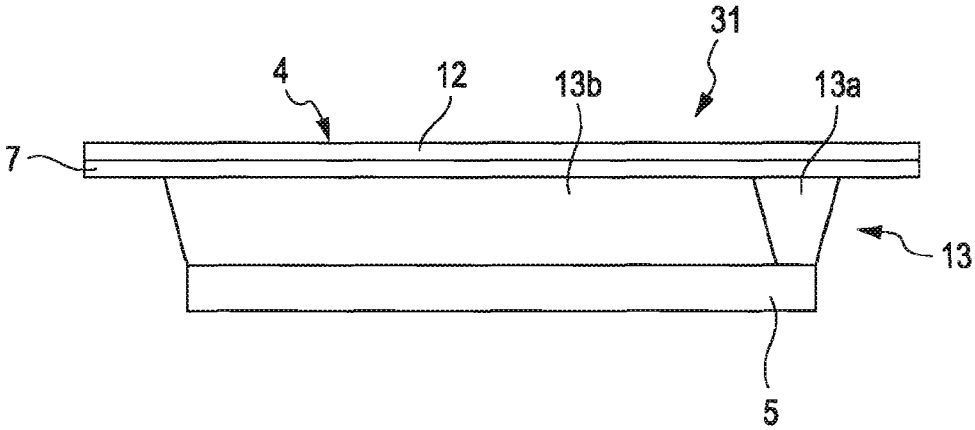
FIG. 8 is a side view illustrating part of a printer head according to the second embodiment.

FIG. 7 perspectively shows part of the printer 30 to which the printer head 31 according to the second embodiment is applied. FIG. 8 shows the printer head 31 in a side view.

The printer head 2 according to the first embodiment includes the light source array 4, the lens array 5, and the spacer member 6 interposed between the light source array 4 and the lens array 5, and these components including the light source array 4, the lens array 5, and the spacer member are joined to each other by adhesives 13 and 14. However, the printer head 31 according to the second embodiment includes a light source array 4 and the lens array 5 but does not include a spacer member 6. The light source array 4 and the lens array 5 are jointed to each other with an adhesive 13 provided therebetween.

As shown in FIG. 8, the light source array 4 and the lens array 5 are joined to each other by the light transmissible adhesive 13.

The adhesive 13 includes a first adhesive 13*a* and a second adhesive 13*b*. The first adhesive 13*a* is applied to the light source array 4 and the lens array 5 at corresponding end portions (on the right side in FIG. 8) over the entire widthwise length of the printer head 31.

The second adhesive 13*b* is applied to joint surfaces of the light source array 4 and the lens array 5 at regions other than the regions provided with the first adhesive 13*a*. The second adhesive 13*b* occupies a relatively large area of the joint surfaces of the light source array 4 and the lens array 5 in comparison with the first adhesive 13*a*.

Accordingly, according to the second embodiment, the same advantage as the first embodiment can be obtained. In addition, since the light source array 4 and the lens array 5 are joined to each other by the light transmissible adhesive 13 without using the spacer member 6 interposed therebetween, the second embodiment has advantages in that the ratio (the efficiency of light utilization) of light quantity entering the lens array 5 to light quantity from the light source array 4 is increased and the number of components which are used is reduced.

Figure 9:
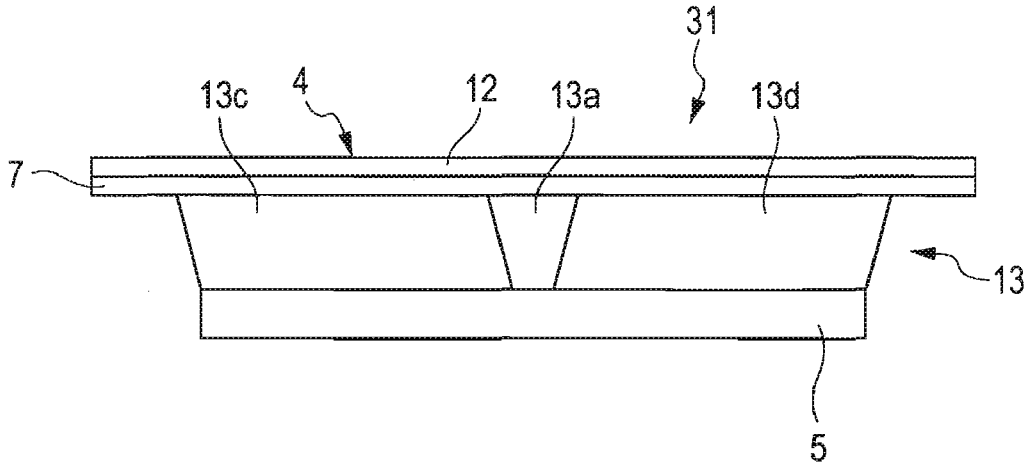
FIG. 9 is a side view illustrating the printer head according to one modification of the second embodiment.

In the second embodiment, the first adhesive 13*a* is disposed on the corresponding one end portions of the element substrate 7 of the light source array 4 and the lens array 5 (see FIG. 8). However, as shown in FIG. 9, alternatively the first adhesive 13*a* may be applied to the element substrate 7 of the light source array 4 and the lens array 5 at corresponding middle portions thereof over the entire widthwise length of the printer head 31, and second adhesives 13*c* and 13*d* may be coated on the joint surfaces of the light source array 4 and the lens array 5 at regions other than the regions provided with the first adhesive 13*a*.

According to this structure, it is possible to more securely maintain the distance between the lens array 5 and the element substrate 7 of the light source array 4 at a constant value while maintaining the stable joint state than the structure in which the first adhesive 13*a* and 14*a* are applied at one end portions of the element substrate 7 of the light source array 4 and the lens array 5.

The printer heads 2 and 31 according to the first embodiment and the second embodiment can be used in an electro-photographic printer 1 which is an image forming apparatus and will be described in greater detail below. The electro-photographic printer includes the printer head 2 or 31 according to the embodiments. Accordingly, it is possible to prevent the printer head from bending upward even at high temperatures in such an electro-photographic printer. For this reason, it is possible to prevent optical characteristics of images formed on the photoconductor drum 3 from being deteriorated, and thus it is possible to provide a printer which can produce high quality images.

In addition, according to the above embodiments, organic EL elements in which excitation by carrier recombination must occur are used as light-emitting elements in which the light-emitting characteristic or light transmittance change according applied electric energy. However, alternatively, the light-emitting elements may be elements which do not need carrier recombination, such as inorganic EL elements, elements which do not need excitation, such as inorganic LED, and light valve elements in which light transmittance changes according to applied electric energy, such as liquid crystal elements.

Further, even though the above embodiments are exemplified using the bottom emission type organic EL device, the present invention may be also applied to the top emission type organic EL device. A pixel electrode of the top emission type organic EL device is made of metal, such as aluminum (Al) and chrome (Cr), having a high refractive index, but it is preferable that the pixel electrode is formed of a stacked structure in which a transparent conductive material film, such as indium tin oxide (ITO) and indium zinc oxide (IZO which is a trademark), is stacked on a metal layer in order to enhance the efficiency of hole injection.

The above embodiments relate to the case in which temperature of the printer head 2 or 31 rises. Conversely, the present invention also may be applied to the case in which temperature of the printer head 2 or 31 falls, for example the case in which the printer is used in cold climates. That is, even in the case in which temperature of the printer falls in cold climates, the second adhesives 13*b* and 14*b* or the liquid provided between the light source array 4 and the spacer member 6 and between the spacer member 6 and the lens array 5 can absorb distortion attributable to the difference between thermal expansion coefficients of the light source array 4, the lens array 5, and the spacer member 6. Accordingly, there is no probability that the printer head 2 or 31 bends in an arc form.

In the above embodiment, the adhesives 13 and 14 are composed of two different kinds of adhesives including the first adhesives 13*a* and 14*a* and the second adhesives 13*b* and 14*b* (13*c*, 13*d*, 14*c*, and 14*d*). Alternatively, the adhesives may be three or more kinds. In the case in which the adhesives are three or more kinds, one kind of the adhesives functions as a gap securing adhesive for maintaining the distance between the element substrate 7 of the light source array 4 and the spacer member 6 and the distance between the spacer member 6 and the lens array 5 always constant. Further, it is preferable that all kinds of the adhesives used in this case have the same refractive index and light transmittance.

The above embodiments relates to the case in which the first adhesives 13*a* and 14*a* are the same kind, but the present invention is not limited thereto. The first adhesives 13*a* and 14*a* may be different kinds as long as they can function as the gap securing adhesive which maintains the distance between two adjacent components always constant and have the same refractive index and light transmittance.

In the first embodiment, the first adhesives 13*a* and 14*a* are applied to one end portions or middle portions of the element substrate 7 of the light source array 4, the lens array 5, and the spacer member 6 over the overall widthwise length of the printer head 2. However, the first adhesives 13*a* and 14*a* may be applied to any positions of the joint surfaces of the element substrate 7 of the light source array 4, the lens array 5, and the spacer member 6.

In the second embodiment, the first adhesive 13*a* is applied to one end portions or middle portions of the element substrate 7 of the light source array 4, the lens array 5, and the spacer member 6 over the overall widthwise length of the printer head 2. However, the first adhesive 13*a* may be applied to any positions of the joint surfaces of the element substrate 7 of the light source array 4, the lens array 5, and the spacer member According to the first and second embodiments, in each joint surface, an area occupied by the second adhesives 13*b* and 14*b* (13*c*, 13*d*, 14*c*, and 14*d*) is larger than an area occupied by the first adhesives 13*a* and 14*a*. However, the present invention is not limited thereto. That is, conversely, the area occupied by the first adhesives 13*a* and 14*a* may be larger than the area occupied by the second adhesives 13*b* and 14*b* (13*c*, 13*d*, 14*c*, and 14*d*). However, the latter case in which the first adhesives 13*a* and 14*a* take more larger area than the second adhesives 13*b* and 14*b* (13*c*, 13*d*, 14*c*, and 14*d*) within each joint surface is inferior to the case in which the second adhesives 13*b* and 14*b* (13*c*, 13*d*, 14*c*, and 14*d*) take more larger area of each bonding surface than the first adhesives 13*a* and 14*a* in performance of absorbing distortion of the printer head. That is, as the second adhesives 13*b* and 14*b* (13*c*, 13*d*, 14*c*, and 14*d*) take larger area, the performance of absorbing distortion becomes more excellent. Conversely, as the area taken by the second adhesives 13*b* and 14*b* (13*c*, 13*d*, 14*c*, and 14*d*) becomes smaller, the performance of absorbing distortion becomes poorer.

The first and second embodiments relate to the case in which the thermal expansion coefficients of the spacer member 6 and the lens array 5 are higher than that of the light source array 4. However, the invention is not limited thereto. Even in the case in which the thermal expansion coefficients of every component (the light source array 4, the spacer member 6, and the lens array 5) are different from each other, it is possible to obtain the same advantages as the above-described embodiments.

Third Embodiment

Figure 10:
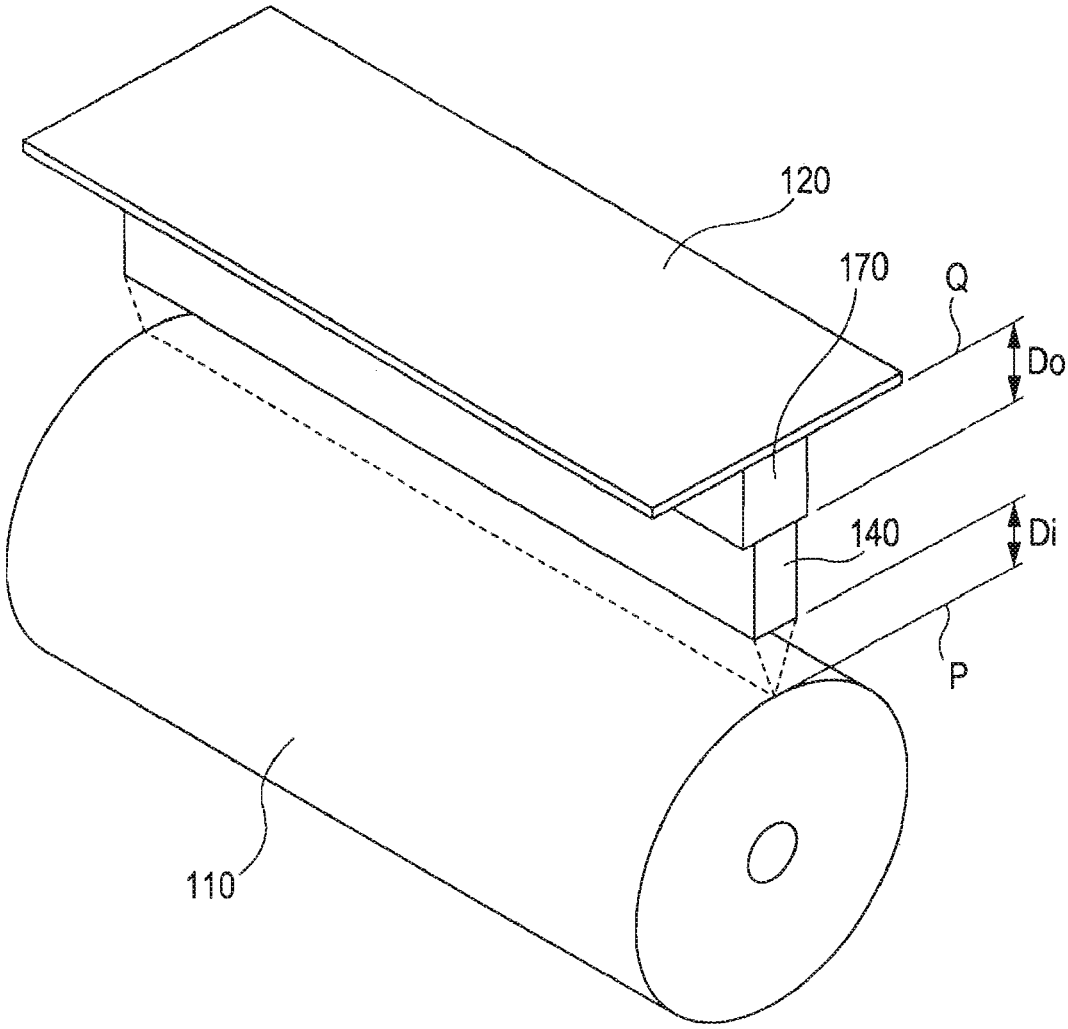
FIG. 10 is a perspective view illustrating part of a known image forming apparatus.

A known technique on which the invention is based will be described below. FIG. 10 perspectively shows part of a known image forming apparatus. In the image forming apparatus, a converging lens array 140 is arranged between a light-emitting panel 120 on which an EL element array is installed and a photoconductor drum 110, and a light transmissible spacer 170 is arranged between the light-emitting panel 120 and the converging lens array 140. The converging array lens 140 is, for example, SELFOC lens array (SLA) ("SELFOC" is a trademark) available from Nippon Sheet Glass Co., Ltd.

Figure 11:
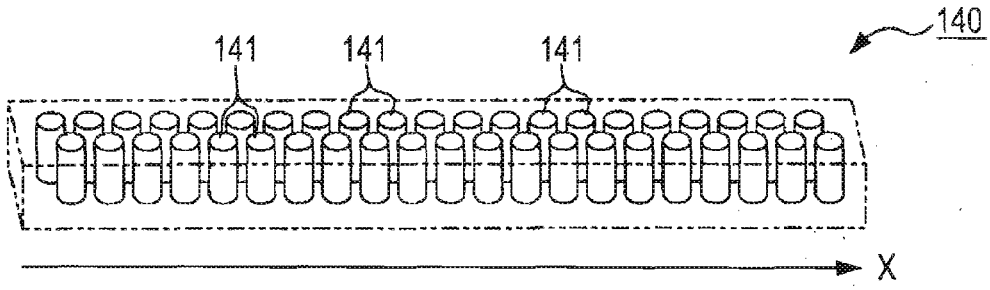
FIG. 11 is a perspective view illustrating a converging lens array of the image forming apparatus shown in FIG. 10.

FIG. 11 perspectively shows the converging lens array 140. The converging lens array 140 includes a plurality of refractive index distribution type lenses 141 arranged in a zigzag form in one direction. Each of the refractive index distribution type lenses 141 is a graded index optical fiber having a graded refractive index profile in which the refractive index is the lowest at the central axis and becomes higher as it becomes farther from the central axis. The converging lens array 140 allows light from the light-emitting panel 120 to pass therethrough so that an one-to-one magnification erect with respect to an image recorded in the light-emitting panel 120 can be formed on the photoconductor drum 110. The image obtained by the plurality of refractive index distribution type lenses 141 constitutes a single continuous image on the photoconductor drum 110.

Figure 12:
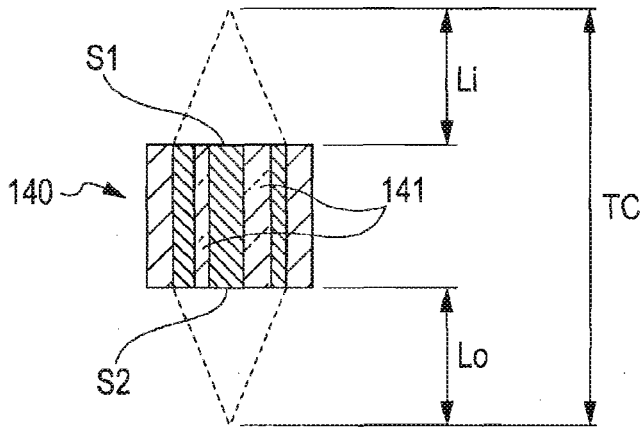
FIG. 12 is a sectional view illustrating the converging lens array shown in FIG. 1.

FIG. 12 shows a section of the converging lens array 140, taken along a plane perpendicular to an arrangement direction (hereineafter, referred to as "X direction") of the refractive index distribution type lenses 141. As shown in FIG. 12, an optical path length of the converging lens array 140 includes an object side operating length Lo, an image side operating length Li and a conjugation length TC. In order to sufficiently improve the optical characteristics (for example, definition) of an image imaged on the photoconductor drum 110, the photoconductor drum 110 and the converging lens array 140 are arranged in a manner such that a distance D1 between an imaging surface P of the photoconductor drum 110 and a light exit surface S1 of the converging lens array 140 is equal to the image side operating length Li, and the light-emitting panel 120 and the converging lens array 140 are arranged in a manner such that a distance Do between a light-emitting surface of the light-emitting panel 120 and a light incidence surface of the converging lens array 140 is equal to the object side operating length Lo.

Figure 13:
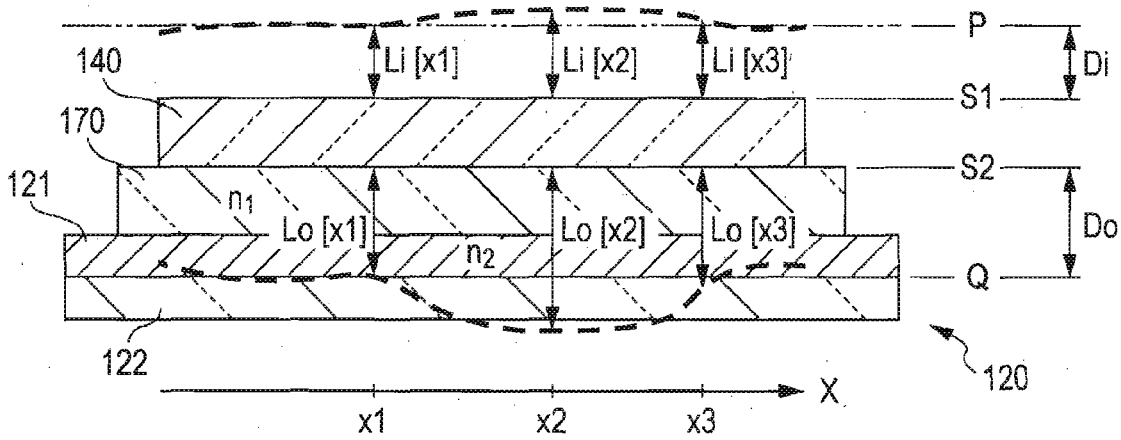
FIG. 13 is a side view illustrating part of the image forming apparatus shown in FIG. 10.

FIG. 13 shows part of the known image forming apparatus in a side view. As shown in FIG. 13, the operating lengths Li and Lo of the converging lens array 140 generally vary in X direction. For example, at a first position x1, a second position x2 and a third position x3 arranged in order in X direction, the image side operating lengths Li(x1), Li(x2), and Li(x3) at the positions x1, x2 and x3 are different from each other and the object side operating lengths Lo(x1), Lo(x2), and Lo(x3) at the positions x1, x2 and x3 are also different from each other. In greater detail, the relationship between the operating lengths are expressed as Li(x1)<Li(x3)<<Li(x2) and Li(xo) <Lo(x3)<<Lo(x2).

As well known from the above description, variation of Li and Lo in X direction may not be linear. At this time, all of the imaging surface P, the light exit surface S1, the light incident surface S2 and the light-emitting surface Q are flat. Accordingly, it is difficult to arrange the photoconductor drum 110 and the converging lens array 140 in a manner such that the distance Di and the operating length Li accord with each other with high precision over the overall length of the converging array 140, and it is also difficult to arrange the light-emitting panel 120 and the converging lens array 140 in a manner such that the distance Do and the operating length Lo accords with each other with high precision over the overall length of the converging lens array 140. Thus, there is probability that optical characteristics of an image imaged on the photoconductor drum vary in X direction in the known image forming apparatus.

Figure 14:
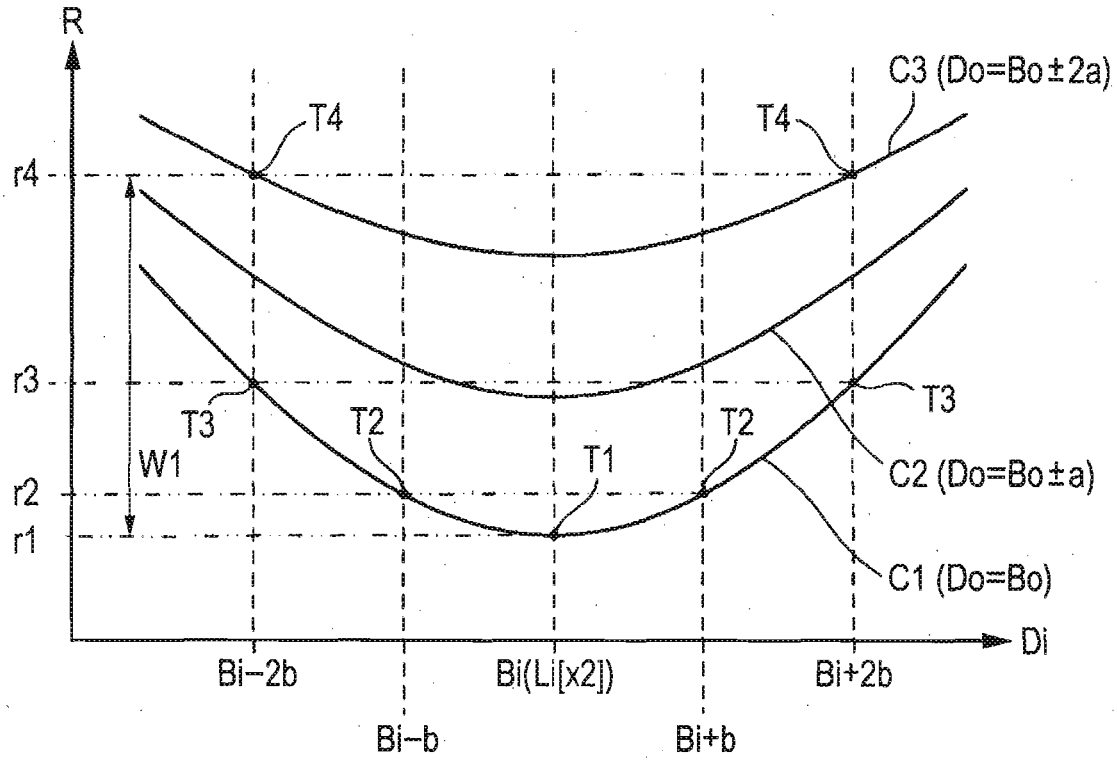
FIG. 14 is a graph illustrating the characteristic of an imaging diameter R of the image forming apparatus shown in FIG. 10.

FIG. 14 shows a graph illustrating the relationship between the distance Di and an imaging diameter R. The imaging diameter R is a diameter of an image on the EL elements which relates to an image on the imaging surface P. As the imaging diameter R become smaller, the more excellent optical characteristics of formed images can be obtained. The characteristic line C1 relates to the characteristic at positions (in X direction) where the distance Do and the operating length Lo are equal to each other, so that the differential between the distance Do and the operating length Lo is an ideal distance Bo, zero (0). Assumed that ½ of the maximum differential between the distance Lo and the ideal distance Bo is a (a>0), the characteristic line C2 indicates the characteristic at positions (in X direction) where the differential between the distance Do and the ideal distance Bo is a. The characteristic line C3 indicates the characteristic at positions (in X direction) where the differential between the distance Do and the ideal distance Bo is two times a.

It can be known from the relative position of the characteristic lines C1 to C3 that the imaging diameter R becomes smaller as the difference between the distance Do and the ideal distance Bo becomes smaller. Further, it can be also understood from the characteristic lines C1 to C3 that the imaging diameter becomes smaller as the differential between the distance Di with the ideal distance Bi in which the distances Di and the operating length Li are equal to each other becomes smaller. For example, in the characteristic line C1, when the differential between the distance Di and the ideal distance Bi is zero (0) (point T1), the imaging diameter R (r1) is smaller than the imaging diameter R (r2) observed when the differential between the distance Di and the ideal distance Bi is b (point T2), and the imaging diameter R(r2) is smaller than the imaging diameter R(r3) observed when the differential between the distance Di and the ideal distance Bi, is two times b (point T3), where b>0.

Assumed that ½ of the maximum differential between the distance Li and the ideal distance Bi is b, the maximum variation W1 of the imaging diameter R in the known image forming apparatus is equal to the differential between r1 and r4. At this time, r4 is an imaging diameter at point T4 where the differential between the distance Di and the ideal distance Bi is two times b and the differential between the distance Do and the ideal distance Bo is two times a. In the known image forming apparatus, occurrence of the great variation in optical characteristics of formed images in X direction is attributed to the very large maximum variation W1 of the imaging diameter R. A third embodiment and a fourth embodiment of the invention are provided to solve this problem.

Hereinafter, an electro-optical device 1A according to the third embodiment will be described. In the electro-optical device 1A, a spacer is formed of a single layer which intersects an optical axis of a refractive index distribution type lens, and a plurality of members having different refractive indexes is continuously arranged in one direction in the single layer.

First, a structure of the electro-optical device 1A will be described.

Figure 15:
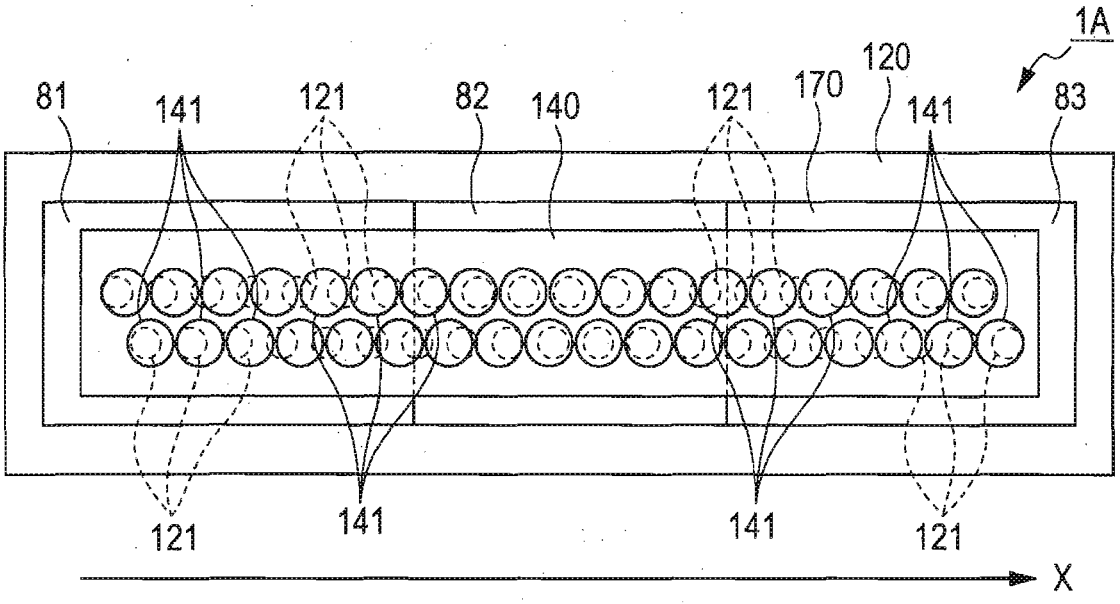
FIG. 15 is a plan view illustrating an electro-optical device according to a third embodiment.
Figure 16:
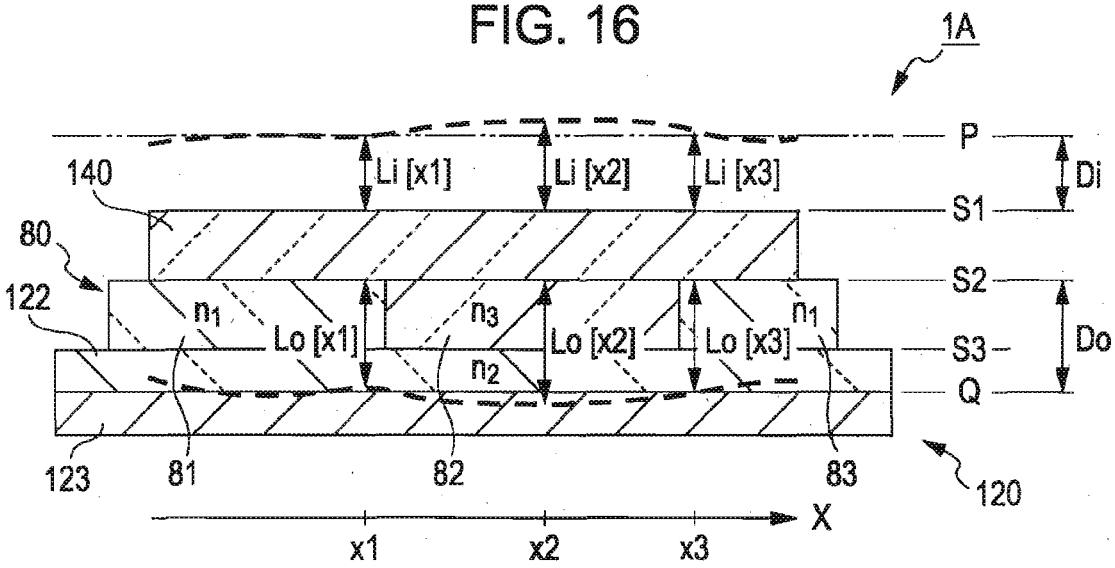
FIG. 16 is a side view illustrating the electro-optical device shown in FIG. 15.

FIG. 15 is a plan view of the electro-optical device 1A and FIG. 16 is a side view (elevation view) of the electro-optical device 1A. The electro-optical device 1A includes a light-emitting panel 120 which is an electro-optical panel, a converging lens array 140, and a light transmissible spacer 80 interposed between the light-emitting panel 120 and the converging lens array 140. The light-emitting panel 120 has a light transmissible element substrate 122, a plurality of EL elements 121 formed on the element substrate 122 and a sealing member 123 covering the EL elements 121. The light-emitting panel 120 emits light from the light-emitting elements 121 from a light exit surface S3 of the element substrate 122.

Each EL element 121 is an electro-optical element in which light-emitting characteristics thereof chance according to applied electric energy. In greater detail, the E1 elements 121 is an organic EL element which includes a light-emitting layer emitting light based on carrier recombination and a pair of electrodes with the light-emitting layer therebetween, and which emits light in response to a voltage acrossing the pair of electrodes. Of the pair of electrodes, an element substrate side electrode is a transparent electrode made of ITO. The light-emitting panel 120 is provided with wirings which supplies a driving voltage to each EL element 120. The light-emitting panel 120 may be further provided with circuit elements (for example, thin film transistors (TFTs)) which apply a driving voltage to each EL element 121.

The element substrate 122 is made of a light transmissible material, such as glass and transparent plastic. The element substrate 122 has a plate shape and a refractive index thereof is $n_2$. The EL elements 121 are arranged on the element substrate 122 in two columns in a zigzag form. A planar surface at an exit end of the EL elements 121 is a light-emitting surface Q. The sealing member 123 is joined to the element substrate 122 so that it isolates the EL elements 121 from ambient air, moisture and oxygen so as to suppress deterioration of the EL elements 121 by cooperating with the element substrate 122.

The converging lens array 140 transmits some portions of light entering the light incident surface S2 so as to allow the light to exit from the light exit surface S1. The converging lens array 140 includes a plurality of refractive index distribution type lenses 141 which allow light from the light-emitting panel 120 to pass therethrough so as to form an erect image with respect to an image of the light-emitting surface (image on the light-emitting panel 120). The light incident surface S2 and the light exit surface S3 of the light-emitting panel 120 face each other and a distance Do between the light-emitting surface Q and the light exit surface S3 is almost the same as the sum of a thickness of the element substrate 122 and a thickness of the spacer 80. The electro-optical device 1A is arranged in a manner such that a distance Di between the light-emitting surface S1 and the imaging surface P is equal to the image side operating length Li of the converging lens array 140.

Each refractive index distribution type lens 141 is arranged in two columns in a zigzag form in X direction and overlaps a region in which the EL elements 121 of the light-emitting panel 120 are arranged. Images obtained by the plurality of refractive index distribution type lens 141 constitute a single continuous image. The arrangement pattern of the EL elements 121 and the refractive index distribution lens 141 are not limited thereto but may be a single column pattern, three or more columns pattern, or other proper patterns.

The spacer 80 has a uniform thickness over the overall area thereof and is disposed between the light-emitting panel 120 and the converging lens array 140 in order to maintain a distance (gap) between the light-emitting panel 120 and the converging lens array 140 always constant. The spacer 80 extends so as to intersect the optical axis of each refractive index distribution type lens 141 and includes a plurality of rectangular parallelepiped members 81, 82, and 83 made of glass or transparent plastic and extending in X direction. The spacer 80 transmits light from the light-emitting panel 120. Of surfaces of the spacer 80, the overall area of the surface on the light-emitting panel side is in contact with the light exit surface S3 of the light-emitting panel 120, and the overall area of the surface on the converging lens array side is in contact with the light incidence surface S2 of the converging lens array 140.

Each of the members 81 to 83 is in contact with the light exit surface S3 of the light-emitting panel 120 and the light incidence surface S2 of the converging lens array 140. The refractive index of the member 82 is $n_3$ and the refractive index of the members 81 and 83 having the member 82 therebetween is $n_1$. That is, a plurality of members having different refractive indexes extending in X direction constitutes the spacer 80. Accordingly, an optical length between the light-emitting surface Q and the light incidence surface S2 in X direction can be diversified.

The refractive indexes $n_1$, $n_2$ and $n_3$, the thickness of the spacer 80, and areas taken by the members 81, 82, and 83 in X direction are determined so as to satisfy Expression 1 on the basis of the operating length Lo of the converging lens array 140:

$$Lo = \sum_{i=1}^{m} \frac{d_i}{n_i} \tag{1}$$

In Expression 1, m is the number of layers provided between the light-emitting surface Q and the light incidence surface S2. According to this embodiment, each of the surface 80 and the element substrate 22 constitutes one layer. Further, $n_i$ and $d_i$ define a refractive index and a thickness of i-th layer, respectively.

The refractive index $n_2$ of the element substrate 122 is determined according to the specification that must be met by the light-emitting panel 120. The thickness of the spacer 80 is uniform in X direction. Accordingly, the refractive index $n_3$ of the members 81 and 83, the refractive index $n_1$ of the member 82 and the areas taken by the members 81 to 83 are determined when a position in X direction is determined. In greater detail, as shown in FIG. 16, the member 81 having a relatively high refractive index of $n_1$ takes up around a first position x1, the member 83 having a relatively high refractive index of $n_1$ takes up around a second position x2, and the member 82 having a relatively low refractive index of $n_3$ takes up around a third position x3, Accordingly, as known from comparison between FIG. 13 and FIG. 16, deviation between the surface spaced apart from the light incidence surface S2 of the converging lens array 140 by the ideal distance Bo which is equal to Lo and the light-emitting surface Q is suppressed to the minimum. The ideal distance Bo defines a distance between the light-emitting surface Q and the light incidence surface S2, when the optical path length between the light-emitting surface Q and the light incidence surface S2 equals operating length Lo.

Figure 17:
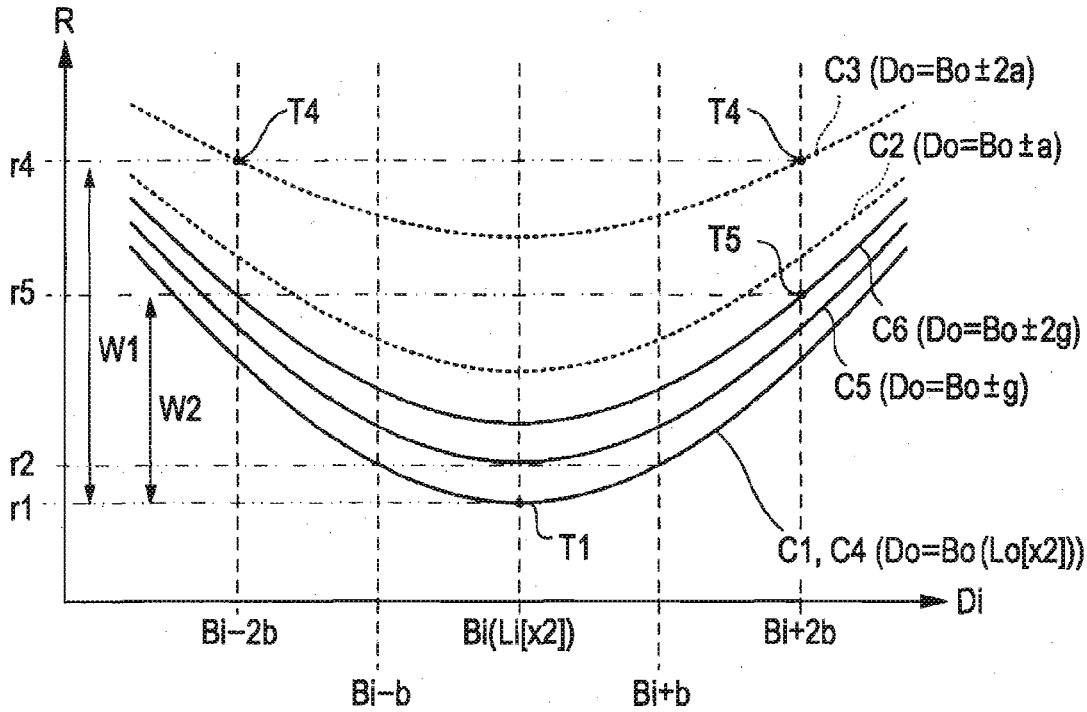
FIG. 17 is a graph illustrating the characteristic of an imaging diameter R in an image forming apparatus using the electro-optical device shown in FIG. 15 as an optical head.

FIG. 17 shows a characteristic graph illustrating the relationship between the distance Di and the imaging diameter R in the image forming apparatus using the electro-optical device 1 as an optical head. The imaging diameter R is a diameter of an image on the EL element relating to an image on the imaging surface P. As the imaging diameter becomes smaller, optical characteristics of formed images become more excellent. Characteristic lines C1 to C3 of characteristic lines C1 to C6 are identical to those shown in FIG. 13 and characteristic lines C4 to C6 relate to the electro-optical device 1A.

The characteristic line C4 indicates the characteristic at positions (in X direction) in which the differential between Do and Bo is zero (0), the characteristic line C5 indicates the characteristic at positions in which the differential between Lo and Bo is g when ½ of the maximum differential between Lo and Bo is defined as g (g>0), and the characteristic line C6 indicates the characteristic at positions in which the differential between Do and Bo is two times g when ½ of the maximum differential between Lo and Bo is defined as g (g>0). The characteristic line C4 perfectly accords with the characteristic line C1.

As described above, in the electro-optical device 1A, deviation between the surface spaced apart from the light incidence surface S2 of the converging lens array 140 by Bo and the light-emitting surface Q is suppressed to the minimum. Accordingly, the maximum differential between Do and Bo is smaller than that of the known image forming apparatus. That is, g<a. For this reason, as shown in FIG. 17, density of the characteristic lines C4 to C6 is thinner than that of the characteristic lines C1 to C3, the maximum variation W2 of the imaging diameter R in the image forming apparatus using the electro-optical device 1A as an optical head is smaller than W1. For the reference, the maximum variation W2 of the imaging diameter R is the differential between r1 and r5, and r5 is a imaging diameter R at a point T5 in which the differential between the Di and Bi is two times b and the differential between Do and Bo is two times g.

As described above, the electro-optical device 1A includes the light-emitting panel 120, the converging lens array 140 having the plurality of refractive index distribution type lenses 141 allowing light from the light-emitting panel 120 to pass therethrough so that en erect image with respect to an image on the light-emitting panel 120 can be imaged and forming a single continuous image using images obtained by the plurality of refractive index distribution type lenses 141, and the spacer 80 interposed between the light-emitting panel 120 and the converging lens array 140. In the spacer 80, the plurality of members 81 and 82 or 82 and 83 having different refractive indexes are continuously extend in X direction. According to the electro-optical device 1A, although physical distances between the light-emitting panel 120 and the converging lens array 140 over the overall area thereof are uniform, it is possible to vary the optical length between the light-emitting panel 120 and the converging lens 140 over the overall area thereof. In addition, In the electro-optical device 1A, the arrangement of the members 81 to 83 and the refractive indexes of the members 81 to 83 are determined according to the operating length Lo of the converging lens array 140. Accordingly, it is possible to decrease the variation (in X direction) in optical characteristics of formed images by the electro-optical device 1A.

Manufacturing Methods of Third Embodiment

Hereinafter, a manufacturing method of the electro-optical device 1A according to the third embodiment will be described. There can be many different methods of manufacturing the electro-optical device 1A. Here, a first manufacturing method and a second manufacturing method will be exemplified.

First Manufacturing Method of Third Embodiment

In the first manufacturing method, the light-emitting panel 120 and the spacer 80 are manufactured first. In order to manufacture the light-emitting panel 120, a light transmissible flat plate having a refractive index of $n_2$ is used as the element substrate 122, and the EL elements 121 are arranged on the element substrate 122 in two columns in a zigzag form. In order to manufacture the spacer 80, the object side operating length Lo of the converging lens array 140 is measured. For the measurement, a work for setting the operating length Lo by the distance between the light emitting surface and the converging lens array 140 when an imaging diameter of light which is emitted from the light source and then passed out the converging lens array 140 is the minimum is repeatedly performed, using a system in which only air exists between the light source array and the converging lens array 140, the relational position between the light source and the converging array 140 is variable, and the relational position between the converging lens array 140 and an imaging surface is fixed.

In order to manufacture the spacer 80, in a subsequent process, refractive indexes, dimensions and arrangement of the members 81 to 83 are determined on the basis of the measured operating length Lo, and then the members 81 to 83 are jointed. In greater detail, the refractive indexes of the members 81 and 83 are set to $n_1$ and a refractive index of the member 82 is set to $n_3$. Further, the members 81 to 83 are positioned in a manner such that the member 83 is interposed between the members 81 and 83 in one direction. In addition, the member 81 takes around the first position (x1), the member 82 takes around the second position (x2), and the member 83 takes around the third position (x3) in the case in which the one direction is X direction in the state in which the members 81 to 83 continuously extend in one direction.

Figure 18:
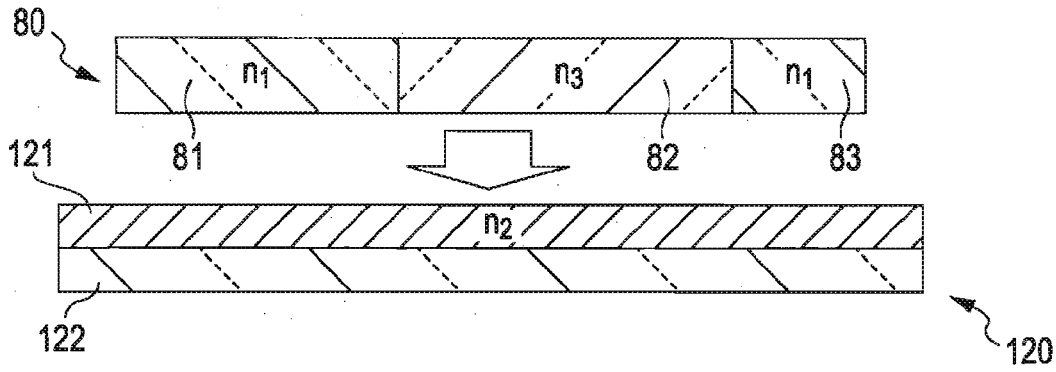
FIGS. 18 and 19 are views illustrating a manufacturing method of the electro-optical device shown in FIG. 15.
Figure 19:
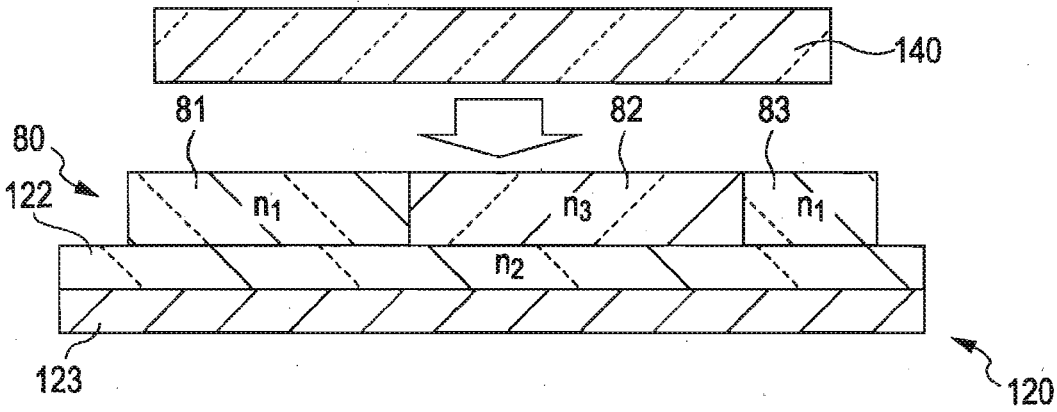

As shown in FIG. 18, the spacer 80 is joined to the light-emitting panel 120. That is, the joint is performed in a manner such that the overall area of the widest surface of the spacer 80 comes into contact with the light exit surface S3 of the light-emitting panel 120, the widest surface of the spacer 80 overlaps the overall area of a region of the light-emitting panel 120, in which the EL elements 121 are formed, and the one direction and an arrangement direction of the EL elements 121 accord with each other. Next, as shown in FIG. 19, the converging lens array 140 is joined to the spacer 80. The joint is performed in a manner such that the overall area of the light incidence surface S2 of the converging lens array 140 comes in to contact with the widest surface of the spacer 80, the arrangement direction (x direction) of the refractive index distribution type lenses 141 of the converging lens array 140 accords with the one direction, and each refractive index distribution type lens 141 overlaps a region in which each EL element 121 of the light-emitting panel 120 is formed.

Next, relational positions of the light-emitting panel 120, the spacer 80, and the converging lens array 140 are fixed. At this time, any fixing methods and structures can be used. That is, sides of the spacers 80 can be bonded to the light-emitting panel 120 and the converging lens array 14. Alternatively, the light-emitting panel 120 and the converging lens array 140 can be received in a casing which is used to join the light-emitting panel 120 and the converging lens array 140 to the spacer 80.

Second Manufacturing Method of Third Embodiment

In a second method, first, the light-emitting panel 120 and the member 32 are manufactured. In order to manufacture the member 82, the object side operating length Lo of the converging lens array 140 is measured. Next, refractive indexes, dimensions and arrangement of the members 81 to 83 are determined on the basis of the measured objected side operating length Lo, and then the member 82 is manufactured.

Figure 20:
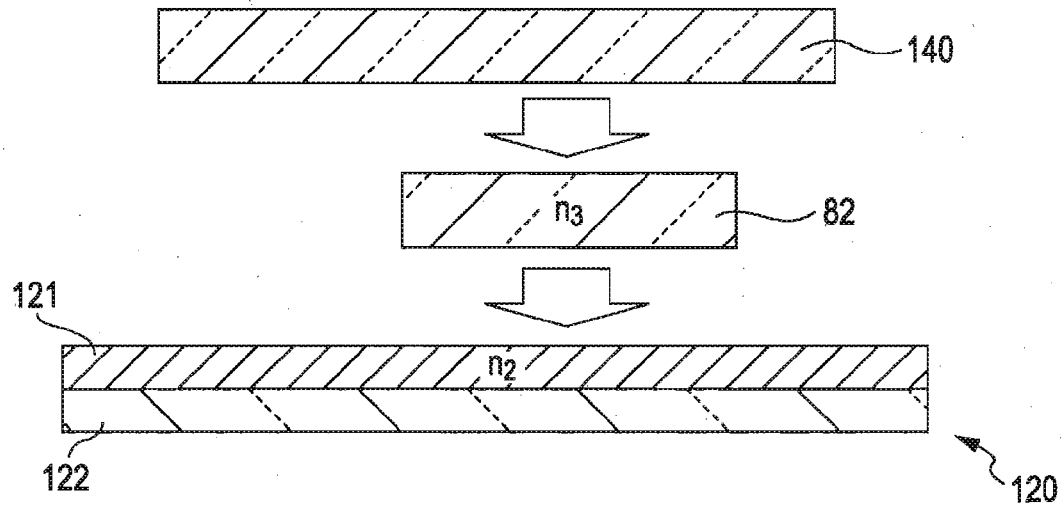
FIGS. 20 and 21 are views illustrating another manufacturing method of the electro-optical device shown in FIG. 15.
Figure 21:
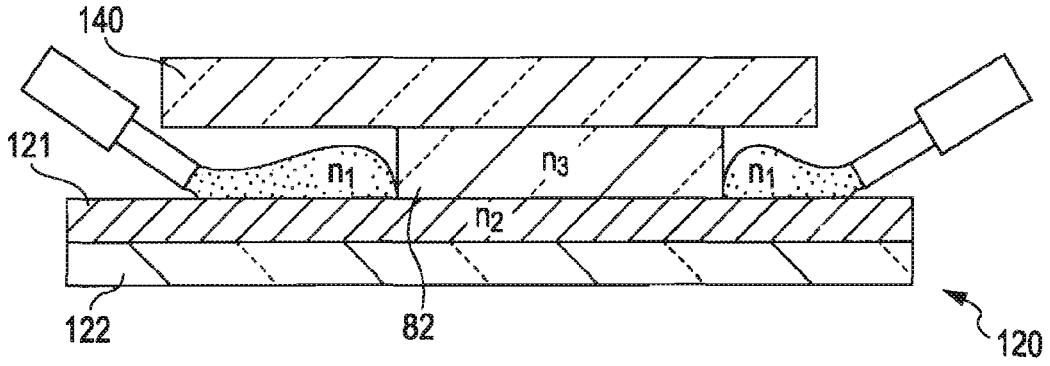

Next, as shown in FIG. 20, the spacer 80 is joined to the light-emitting panel 120, and then converging lens array 140 is joined to spacer 80. Next, as shown in FIG. 21, a transparent adhesive having a refractive index (after curing) of $n_1$ is injected into a gap between the light-emitting panel 120 and the converging lens array 140, and then the transparent adhesive is cured so as to form the members 81 and 83. At this time, a guide frame may be used in order to prevent the adhesive which is a fluidic before curing from leaking and make the adhesive have a desired form after curing.

Fourth Embodiment

Next, an electro-optical device 1B according to a fourth embodiment of the invention will be described. In the electro-optical device 1B, a spacer includes a plurality of layers crossing an optical axis of each refractive index distribution type lense. In at least two of the plurality of layers, a plurality of members having different refractive indexes is arranged in one direction. Hereinafter, points in which the electro-optical device 1B according to the fourth embodiment is different from the electro-optical device 1A according to the third embodiment will be described in detail.

A structure of the electro-optical device 1B will be described first.

Figure 22:
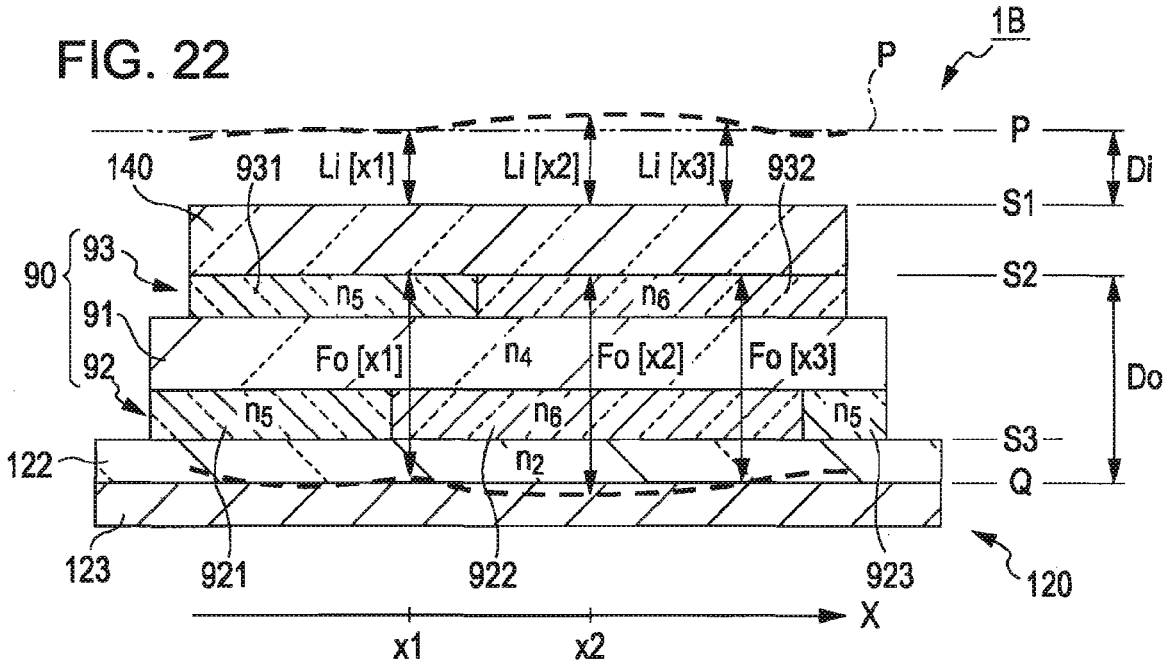
FIG. 22 is a side view illustrating an electro-optical device according to a fourth embodiment.

FIG. 22 is a side view (elevation view) illustrating the electro-optical device 1B. The electro-optical device 1B is different from the electro-optical device 1A in that the electro-optical device 1B includes a spacer 90 in stead of the spacer 80. The spacer 90 is a component interposed between a light-emitting panel 120 and a converging lens array 140 in order to space the a light-emitting panel 120 and a converging lens array 140 apart from each other by a predetermined constant distance. The spacer 90 includes a plurality of light transmissible layers 91 to 93 which continuously extends so as to intersect an optical axis of each refractive index distribution type lens 141 and allows light from the light-emitting panel 120 to pass therethrough.

The layer 91 is a body having a uniform thickness and interposed between the layers 91 and 93. The layer 91 is made of glass or transparent plastic. The layer 91 has a refractive index of $n_1$. The entire surface of the layer 91, which is near the light-emitting panel 120, is in contact with the entire surface of the layer 92, which is near the converging lens array 140, and the entire surface of the layer 91, which is near the converging lens array 140 is in contact with the entire surface of the layer 93, which is near the light-emitting panel 120.

The layer 92 has a uniform thickness and is interposed between the layer 91 and the light-emitting panel 120. The layer 92 includes a plurality of rectangular parallelepiped members 921 to 923 which is continuously arranged in this order in X direction. The member 922 is a transparent adhesive having a refractive index of $n_6$ and the members 921 and member 923 are a transparent adhesive having a refractive index of $n_5$. That is, the layer 90 is constituted by members having different refractive indexes and is connected to each other in continuous manner in order in X direction.

The layer 93 has a uniform thickness and is interposed between the converging lens array 140 and the layer 91. The layer 93 includes a plurality of members 931 to 933 which are rectangular parallelepiped bodies and continuously arranged in order in X direction. The member 931 is a transparent adhesive having a refractive index of $n_5$, and the member 932 is a transparent adhesive having a refractive index of $n_6$. That is, in the layer 93, a plurality of members having different refractive indexes is connected in order in X direction. The refractive index distribution of the members in the layer 93 does not perfectly accord with the refractive index distribution of the members in the layer 92. That is, the refractive index distribution profiles in the layers are different from each other.

Refractive indexes $n_2$, $n_4$, $n_5$, and $n_6$, thicknesses of the layers 91 to 93, areas (in X direction) taken by the members 921 to 923 and 931 to 932 (occupied areas of the members 921 to 923 and 931 to 932) are determined so as to satisfy Expression 1, based on the object side operating length Lo of the converging lens array 140. The refractive index of $n_2$ is generally determined so as to meet the specification of the light-emitting panel 120. The refractive index of $n_4$ of the layer 91 and the thicknesses of the layers 91 to 93 are equal to each other in X direction. Accordingly, only the refractive indexes of $n_5$ and $n_6$, and the occupied areas of the members 921 to 923 and 931 to 932 are determined according to positions in X direction.

As is clear from the above description, the electro-optical device 1B has the same advantages as the electro-optical device 1A. In addition, in the case in which either of the layers 92 and 93 is not included, only two kinds of optical path length can be obtained even through it is possible to diversify the optical path length between the light-emitting surface Q and the light incidence surface S2 using the members having a refractive index of $n_5$ and a refractive index of $n_6$, respectively. However, according to the electro-optical device 1B, since the spacer 90 uses the layers 92 and 93, each constituted by including a plurality of members having different refractive indexes, in which the refractive index distribution of the members in the layer 92 are different from the refractive index distribution of the member in the layer 93, it is possible to more diversely vary the optical path length. This advantage contributes to the decrease in variation of optical characteristics of an imaging in X direction.

Manufacturing Method of Fourth Embodiment

Hereinafter, a method of manufacturing the electro-optical device 1B according to the fourth embodiment will be described. There may be a variety of methods of manufacturing the electro-optical device 1B. Herein, one exemplary manufacturing method is provided.

First, the light-emitting panel 120 and the layer 91 are prepared. Before preparing the layer 91, first, the object side operating length Lo of the converging lens array 140 is measured, and then an refractive index and a thickness of the layer 91, refractive indexes and occupied areas of the members 921 to 923 and 931 to 932 are determined on the basis of the measured object side operating length Lo. After that, the layer having the refractive index of $n_4$ is formed.

Figure 23:
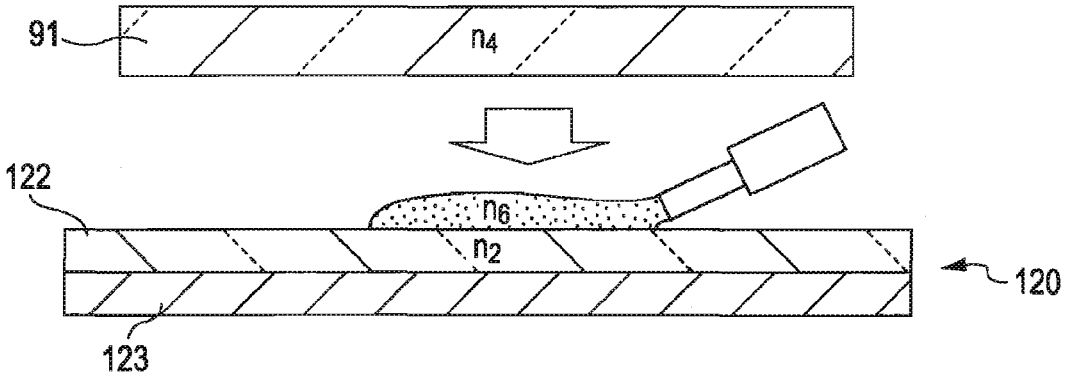
FIGS. 23 to 26 are views illustrating a manufacturing method of the electro-optical device shown in FIG. 22.
Figure 24:
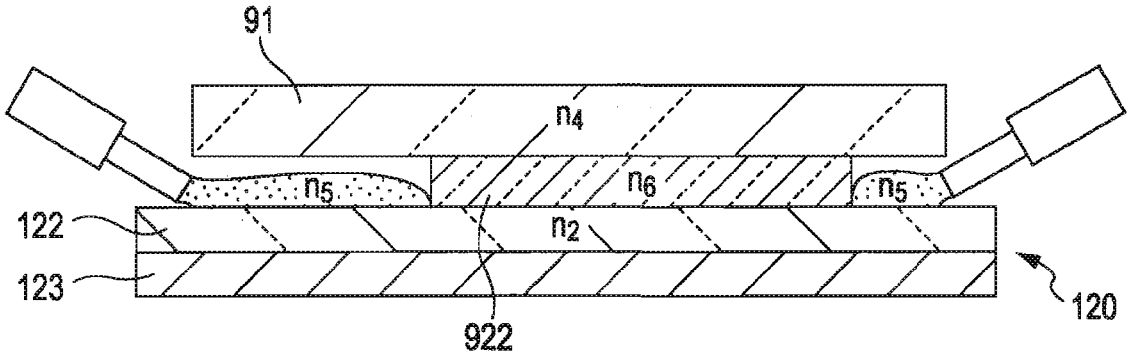

Next, as shown in FIG. 23, a transparent adhesive having a refractive index of $n_6$ after curing is coated at the occupied area of the member 922 on the light exit surface S3 of the light-emitting panel 120, and then the transparent adhesive is compressed using the light-emitting panel 120 and the layer 91 until the transparent adhesive has a predetermined thickness. After that, the transparent adhesive is cured in this state. Then, the layer 91 is joined to the light-emitting panel 120. The cured transparent adhesive becomes the member 922. As shown in FIG. 24, a transparent adhesive having a refractive index of $n_5$ which is a refractive index after curing is injected into a gap between the light-emitting panel 120 and the layer 91, and then the transparent adhesive is cured. The cured adhesive at this time becomes the members 921 and 923.

Figure 25:
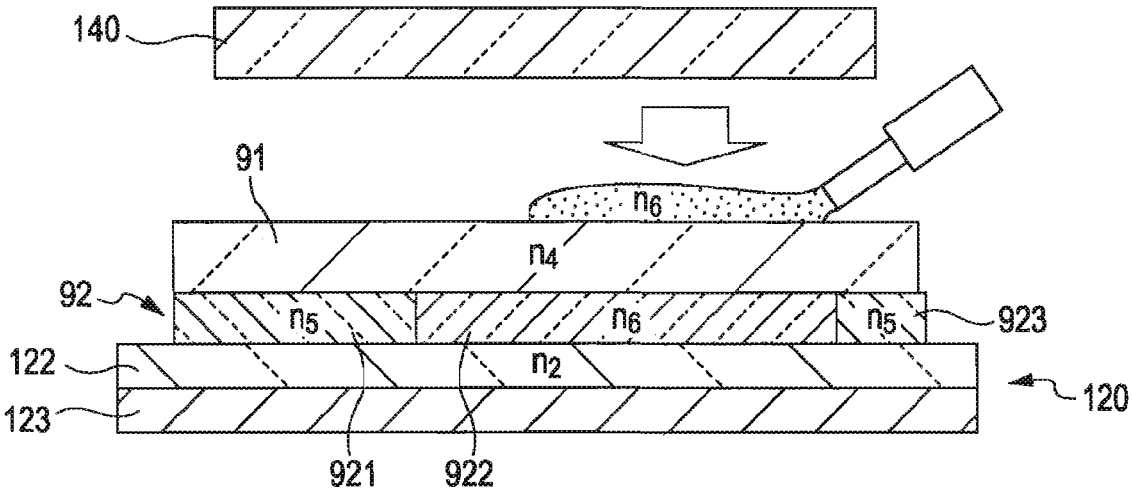
Figure 26:
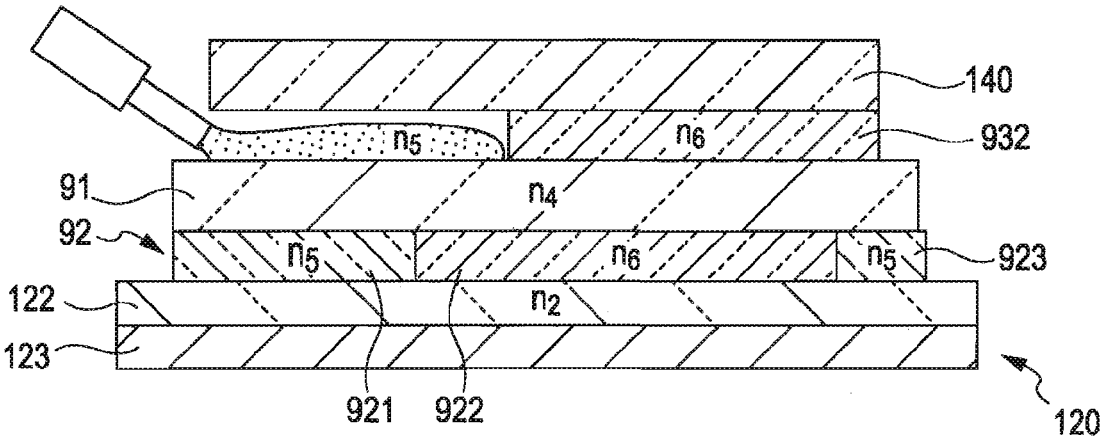

Next, as shown in FIG. 25, a transparent adhesive having a refractive index of $n_6$ which is a refractive index after curing is coated on a surface of the layer 91, which is near the converging lens array 140 at the region which is occupied by the member 932, then the transparent adhesive is pressed by the layer 91 and the converging lens array 140 until the transparent adhesive has a predetermined thickness, and finally the transparent adhesive is cured. Next, the converging lens array 140 is joined to the layer 91. The cured transparent adhesive becomes the member 932. Next, as shown in FIG. 26, a transparent adhesive having a refractive index of $n_5$ which is a refractive index after curing is injected into a gap between the layer 91 and the converging lens array 140, and then cured. The cured transparent adhesive becomes the member 931.

In additions, during the process of coating or injecting the adhesive, a guide frame may be used in order to prevent a fluidic adhesive from leaking and enabling the adhesive to be cured into a desired form. Further, a gap securing member in solid may be used in order to secure the thickness of the adhesive at a proper size when the adhesive is compressed. It is preferable that the gap securing member is made of a light transmissible material, has a ball shape, and has a refractive index which is almost equal to that of adjacent adhesives.

In the fourth embodiment 4, both of the layers 92 and 93 include members having different refractive indexes from each other. However, as one exemplary modification of the fourth embodiment, either one of the layers 92 and 92 may include members having different refractive indexes. On the other hand, as one exemplary modification of the third embodiment, the spacer 80 may include a member which does not affect transmission of light from the light-emitting panel 120. Likewise this modification, the fourth embodiment may be modified in a manner such that at least one of the layers 92 and 93 includes a member which does not affect transmittance of light from the light-emitting panel 120. In other exemplary modifications, the spacer may include three or more layers, each including a plurality of members having different refractive indexes from each other.

The third and fourth embodiments use the bottom emission type light-emitting panel 120 in which light from each EL element 121 penetrates through the element substrate 122 and exits from the light-emitting panel 120. However, the top emission type light-emitting panel in which light exits in the reverse direction can be used. An object which allows light from the plurality of electro-optical devices to pass therethrough may be a sealing member. In such a case, light transmittance of each portion of the sealing member will be determined so as not to block light emitted from each EL element and directing toward side portions thereof.

In the third and fourth embodiments, organic EL elements in which excitation by carrier recombination must be caused so as to emit light are used as the plurality of electro-optical elements in which light-emitting or light transmission characteristic changes according to applied electric energy. However, light-emitting elements which don't require carrier recombination, such as inorganic EL elements, or light-emitting elements which don't require excitation, such as inorganic LEDs, light valves in which light transmission characteristic changes according to applied electric energy, such as liquid crystal elements can be used in stead of the organic EL elements.

Fifth Embodiment

Figure 27:
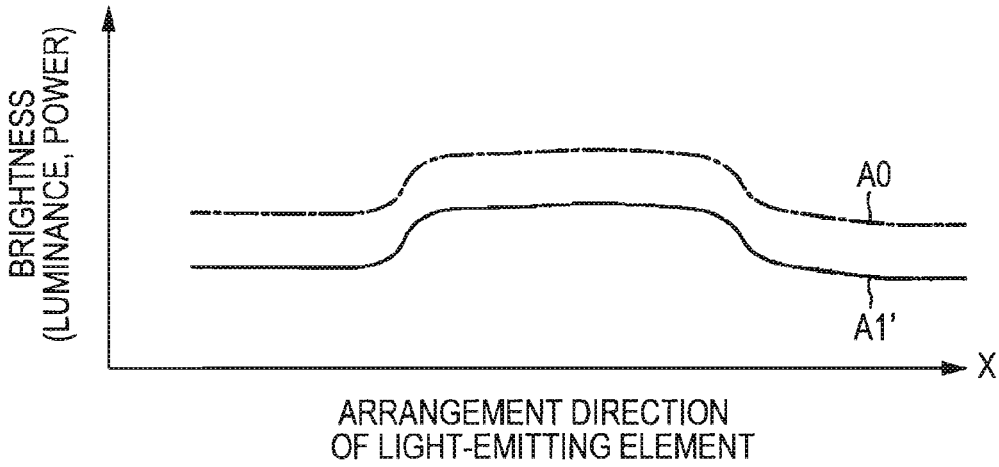
FIG. 27 is a graph illustrating the relationship between a light-emitting device and brightness in a known electro-optical device.

The known image forming apparatus described above with reference to FIGS. 10 to 14 has the following problem. As shown in FIG. 27, as for the light-emitting elements, such as EL elements, constituting the light-emitting panel 120, there is unevenness in brightness (luminance or power). In FIG. 27, a line A1 indicates brightness of light emitted from the light-emitting element and a line A1' indicates brightness on an imaging surface of the image carrier. The unevenness of the brightness is attributed to unevenness in the manufacturing process of the light-emitting devices. If an electrostatic latent image is formed in the state there is unevenness in brightness of the light-emitting elements, a final image, a visible image comes to have density irregularities, so that it is impossible to obtain a clear image. Accordingly, in order to solve the problem of brightness unevenness, JP-A-2006-289721 discloses a technique in which a driving circuit, such as a driver IC, has a function of compensating the unevenness, for example functions of adjusting current, voltage, and light-emitting period.

However, the known technique is disadvantageous in that it is difficult to make the light-emitting panel compact due to the functions provided in the driving circuit and such a device incurs increased cost. Further, the known technique needs a large amount of labor and time because measurement of the brightness of light from the light-emitting elements and adjustment of voltage, current, and light-emitting period are repeatedly conducted many times. Accordingly, the technique is ineffective and incurs a large amount of manufacturing cost. A fifth embodiment and a sixth embodiment of the invention are provided to solve the problem.

Figure 28:
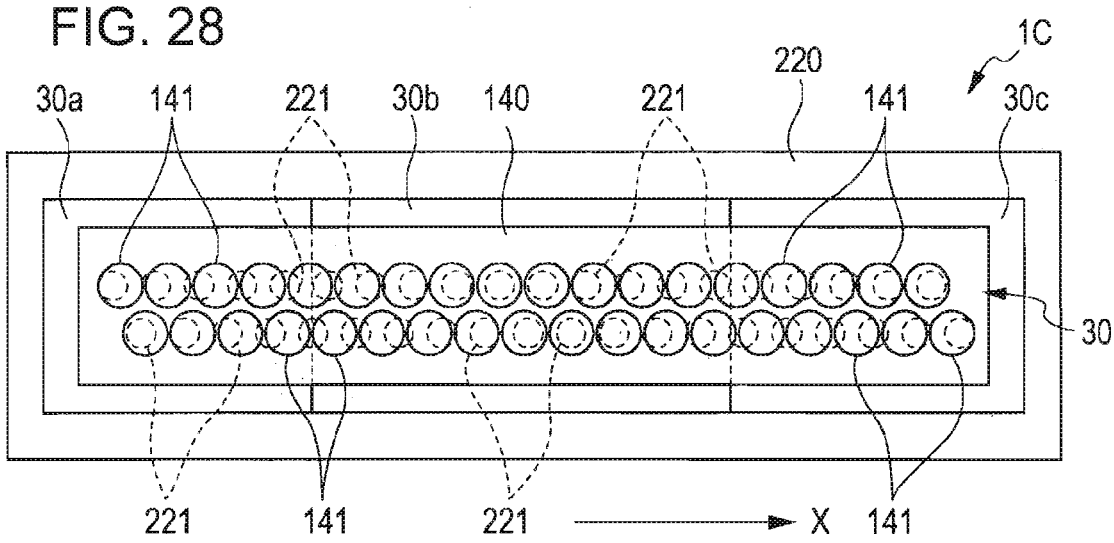
FIG. 28 is a plan view illustrating an electro-optical device according to a fifth embodiment.
Figure 29:
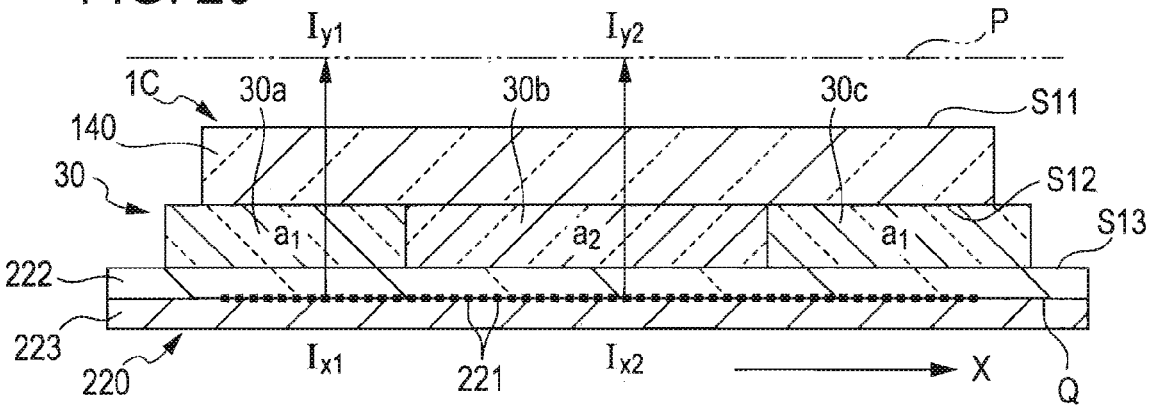
FIG. 29 is a side view illustrating the electro-optical device shown in FIG. 28.

FIGS. 28 and 29 are a plan view and a side view illustrating an electro-optical device according to the fifth embodiment, respectively. As shown in FIGS. 28 and 29, the electro-optical device 1C includes a light-emitting panel (electro-optical panel) 220, a converging lens array 140, and a light transmissible member (spacer) 30 interposed between the light-emitting panel and the converging lens array 140. The light-emitting panel 220 further includes a light transmissible element substrate (array substrate) 222, a plurality of light-emitting elements 221 formed on the element substrate 222 and a sealing member 223 covering the light-emitting elements 221. Light from each light-emitting element 221 exist from a light exit surface S13 (the upper surface in figures) of the element substrate 222.

Each light-emitting element 221 is an electro-optical element having optical characteristics which change according to applied electric energy. In greater detail, the light-emitting element 221 is an organic EL element having a light-emitting layer which emits light based on carrier recombination and having a pair of electrodes with the light-emitting layer interposed therebetween, in which the organic EL element emits light according to a voltage applied across the pair of electrodes. One of the pair of electrodes which is near the element substrate 222 is a transparent electrode made of ITO. The light-emitting panel 220 is provided with wirings which supplies a driving voltage to each light-emitting element 221. In addition, the light-emitting panel 220 may be further provided with a circuit element (for example, thin film transistor (TFT)) which controls supply of the driving voltage to each light-emitting element 221.

The element substrate 222 is a plate shape and made of a light transmissible material such as glass or transparent plastic. The light-emitting elements 221 are arranged on the element substrate 222 in a zigzag form in one direction and a flat surface at one ends of the light-emitting elements constitutes a light-emitting surface Q. The sealing body 223 is joined to the element substrate 222 and isolates the light-emitting elements 221 from ambient air, moisture and oxygen by cooperating with the element substrate 222 so as to suppress deterioration of the light-emitting elements 221.

The converging lens array 140 allows some portions of light of the light incident on its light incidence surface S12 to pass therethrough, so that the some portions of light exits from a light exit surface S11. The converging lens array 140 includes a plurality of refractive index distribution type lens 141, each capable of imaging an erect image with respect to an image on the light-emitting surface Q (an image on the light-emitting panel 220) by allowing the light from the light-emitting panel 220 to transmit therethrough. The light incidence surface S12 of the converging lens array 140 and the light exit surface S13 of the light-emitting panel 220 face each other. A distance between the light-emitting surface Q and the light exit surface S13 is almost equal, to the total of a thickness of the element substrate 222 and a thickness of a light transmissible member 30. In the electro-optical device 1C, the distance between the light exit surface S11 and an imaging surface P is almost equal to an image side operating length of the converging lens array 140.

As shown in FIG. 28, the refractive index distribution type lenses 141 are arranged in a zigzag form in X direction and overlaps regions in which the light-emitting elements 221 of the light-emitting panel 220. Images obtained by the plurality of refractive index distribution type lenses 141 forms a single continuous image. However, the arrangement pattern of the light-emitting elements 221 and the refractive index distribution type lenses 141 is not limited thereto. That is, the light-emitting elements and the refractive index distribution type lenses 141 may be arranged in a single column or three or more columns.

The light transmissible member 30 is interposed between the light-emitting panel 220 and the converging lens array 140 in order to secure a distance between the light-emitting panel 220 and the converging lens array 140. The light transmissible member 30 is structured in a manner such that it can guide light from the light-emitting panel 220 to the converging lens array 140. The light transmissible member 30 is composed of a single layer or a plurality of layers arranged in an optical direction. The light transmissible member 30 extends to cross the optical axis of each refractive index distribution type lens 141. In this embodiment, the light transmissible member 30 is made of glass or transparent plastic and is a rectangular parallelepiped shape elongate in X direction. The light transmissible member 30 allows the light from the light-emitting panel 220 to pass therethrough and guides the light to the converging lens array 140. The overall area of a surface of the light-emitting panel 220, which is near the light-emitting panel 220 is in contact with the light exit surface S13 of the light-emitting panel 220 and the overall area of a surface of the light transmissible member 30 which is near the converging lens array 140 is in contact with the light incidence surface S12 of the converging lens array 140.

This embodiment aims to diversify the light transmittance of the light transmissible member 30, i.e. light transmittance in the optical direction of the lens 141 so that the light transmittance varies according to positions in the arrangement direction of the lenses 141 and the light-emitting elements 221 (X direction in FIGS. 28 and 29). According to this embodiment shown in FIG. 29, the light transmissible member 30 is composed of a single layer which is divided into a plurality of portions 30*a* to 30*c* which are arranged in order in the lengthwise direction (X direction). The portions 30*a* to 30*c* have different refractive indexes from each other. Thanks to the above-mentioned structure, it is possible to improve evenness in brightness of the light-emitting elements 221 serving as the electro-optical elements or brightness of combinations of the light-emitting elements 221 and the corresponding converging lenses array 140.

Figure 30:
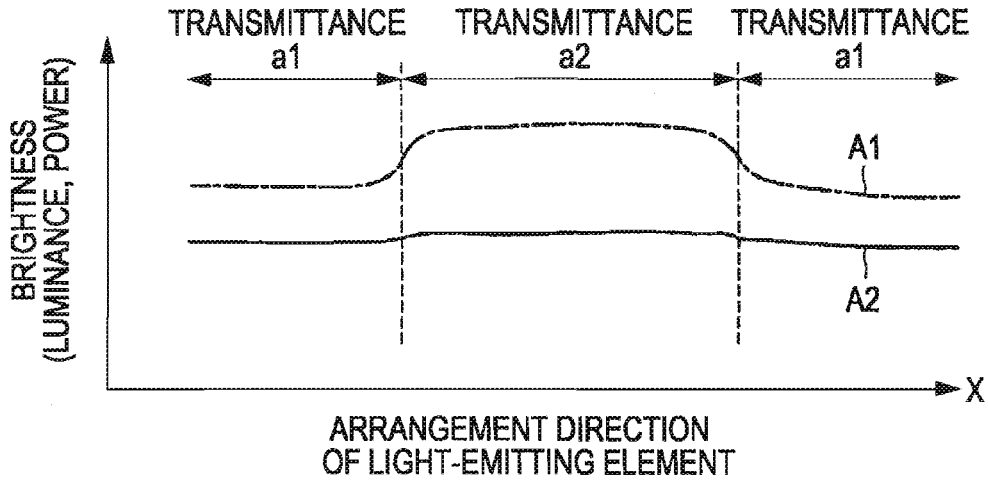
FIG. 30 is a graph illustrating the relationship between a light-emitting element and brightness in the electro-optical device shown in FIG. 28.

In greater detail, brightness of the light from the plurality of light-emitting elements 221 is uneven in the arrangement direction (X direction, left-to-right direction in FIG. 30) of the light-emitting elements 221 or the lenses 141 indicated by the characteristic line A1 as shown in FIG. 30, the light transmittance of the light transmissible member 30 is set to be in inverse proportion to the brightness. As shown in FIG. 30, according to this embodiment, since a center portion in the arrangement direction of the light-emitting elements 221 is brighter than both end portions of the arrangement of the light-emitting elements 221, the light transmittance a1 at both end portions 30*a* and 30*c* of the light transmissible member 30 is higher than the light transmittance a2 of a center portion 30*b* of the light transmissible member 30 in order to offset the brightness variation.

Thanks to such a structure, with reference to FIG. 29, assumed that light imaged on an imaging surface of an image carrier after the light having brightness $I_{x1}$ emitted from the light-emitting element 221 passes through the element substrate 222, the end portion 30*a* (or 30*c*) of the light transmissible member 30 and the converging lens array 140 has brightness $I_{Y1}$, and light imaged on the imaging surface of the image carrier after the light having brightness $I_{x2}$ emitted from the light-emitting element 221 passes through the element substrate 222, the center portion 30*b* of the light transmissible member 30 and the converging lens array 140 has brightness $I_{Y2}$, the brightness $I_{Y1}$ and the brightness $I_{Y2}$ can be almost equal to each other. The relationship of brightness $I_{X1}$, and $I_{X2}$ of emitted light and brightness $I_{Y1}$ and $I_{Y2}$ of imaged light will be expressed by Expressions 2 to 4:

$$I_{Y1}=a_1 \cdot b \cdot s \cdot I_{X1} \quad (2);$$

$$I_{Y2}=a_2 \cdot b \cdot s \cdot I_{X2} \quad (3); \text{ and}$$

$$I_{Y1}=I_{Y2} \quad (4).$$

In Expressions 2 and 3, b defines light transmittance of the element substrate 222 and s defines the light utilization efficiency of the converging lens array.

This embodiment aims to vary the light transmittance of the light transmissible member 30 in the arrangement direction of the lenses 141, so that it is possible to offset unevenness of brightness of the light-emitting elements 221. Further, it is possible to make the light transmissible member 30 have a graded profiled in light transmittance so as to correspond to the brightness of the light-emitting elements 221 in the arrangement direction of the lenses 141, and thus it is possible to offset the unevenness of the brightness of the light-emitting elements having the characteristic of A1 in FIG. 30. In FIG. 30, A2 indicates the brightness after offsetting the unevenness of brightness. That is, A2 indicates the brightness on the imaging surface P when using the structure in which the light transmissible member 30 is present between the light-emitting panel 220 and the converging lens array 140, as shown in FIG. 29. It is found that A2 exhibits less unevenness in brightness than A1.

In the above embodiment, the light transmittance of the light transmissible member 30 varies in a graded profile but the invention is not limited thereto. That is, the light transmittance of the light transmissible member 30 may vary in a continuous profile. In addition, even though the embodiment relates to the offset of brightness unevenness of the light-emitting elements 221, the embodiment can be applied to the case in which the converging lens array 140 has transmittance unevenness or brightness unevenness. In such a case, the light transmissible member 30 may have a different light transmittance profile so as to correspond to combined brightness of the light-emitting elements 221 and the lenses 141 of the converging lens array 140. Further, it is preferable that the light transmissible member 30 is made of a material having light transmittance as high as possible, so that the brightness is improved after offsetting.

As described above, the electro-optical device 1C includes the light-emitting panel 220 serving as the electro-optical panel and having a plurality of light-emitting elements 221 which serves as electro-optical elements, the converging lens array 140 including a plurality of refractive index distribution type lenses 141 arranged in one direction, each lens allowing light from the light-emitting panel 220 serving as the electro-optical panel to transmit therethrough and forming an erect image with respect to an image of the light-emitting panel 220, in which the images obtained by the plurality of refractive index distribution type lenses 141 constitutes a single continuous image, and the light transmissible member 30 interposed between the light-emitting panel 220 and the converging lens array 140 so as to guide light from the light-emitting panel 220 to the converging lens array 140. The light transmissible member 30 has a light transmittance profile in which light transmittance varies in the arrangement direction of the lenses 141. With the structure, it is possible to easily offset unevenness in brightness of light-emitting elements 221 and or combined brightness of the light-emitting elements 221 and the converging lens array 140.

Manufacturing Methods of Fifth Embodiment

Hereinafter, manufacturing methods of the electro-optical device according to the fifth embodiment will be described. There can be various manufacturing methods of the electro-optical device 1C according to the fifth embodiment. Here, two exemplary manufacturing methods are described.

First Manufacturing Method of Fifth Embodiment

In a first manufacturing method, first, the light-emitting panel 220 and the light transmissible member 30 are prepared. In order to manufacture the light-emitting panel 220, a light transmissible plate is used as the element substrate 222, and the plurality of light-emitting elements 221 constituted by EL elements is arranged on the element substrate 222 in one direction (X direction) in a zigzag form, as shown in FIG. 28. In order to manufacture the light transmissible member 30, brightness of light from the plurality of light-emitting elements 221 and brightness of light emitted from the plurality of light-emitting elements 221 and then passed out the converging lens array 140 are measured. In the measurement, the brightness is measured for the light-emitting elements 221 and the lenses 141 of the converging lens array 140, sequentially in the arrangement direction (X direction) of the lenses 141 or in a measuring action.

In the case of measuring the brightness of light from the plurality of light-emitting elements 221, it is preferable that the brightness is measured from light which is emitted from the plurality of light-emitting elements 221 and exiting from a member (for example, the element substrate 222 in this embodiment) constituting the light-emitting panel 220. On the other hand, in the case of measuring the brightness of light passes through the converging lens array 140, the measurement is carried in a state in which the light-emitting elements 221 and the converging lens array 140 are assembled in a predetermined manner or in a state in which the light-emitting elements 221 and the converging lens array 140 are arranged so as to overlap each other in the optical axis of the lenses 141. Further, it is possible to obtain the brightness of light emitted from the light-emitting elements 122 and passed out the converging lens array 140 by measuring the brightness of light exiting from the plurality of light-emitting elements 221, the brightness of light passed through the converging lens array 140, and transmittance or optical attenuation factor of the converging lens array 140, and then performing calculation on the basis of the measurement.

Next, if the brightness unevenness in X direction is observed, the light transmittance profile of the light transmissible member 30 is determined so as to offset the brightness unevenness. As shown in FIG. 29, in the case in which the light transmissible member 30 is constituted by a single layer in which light transmittance varies in the lengthwise direction (X direction) in a graded manner, the light transmissible member 30 is constructed in a manner such that a plurality of individual light transmissible pieces 30*a* to 30*c* having different dimensions (length) and light transmittances is prepared, and then the plurality of light transmissible pieces 30*a* to 30*c* are continuously arranged and connected to each other in the lengthwise direction (X direction) so as to correspond to the variation of the predetermined light transmittance. According to this embodiment, as shown in FIG. 31A, a light transmissible piece 30*b* having a light transmittance a2 is disclosed at a center portion of the light transmissible member 30, light transmissible pieces 30*a* and 30*c* having a light transmittance a1 are disposed at both sides of the light transmissible piece 30*b*, and then the light transmissible pieces 30*a*, 30*b*, 30*c* are integrated into a single body so as to form the light transmissible member 30.

Figure 31A:
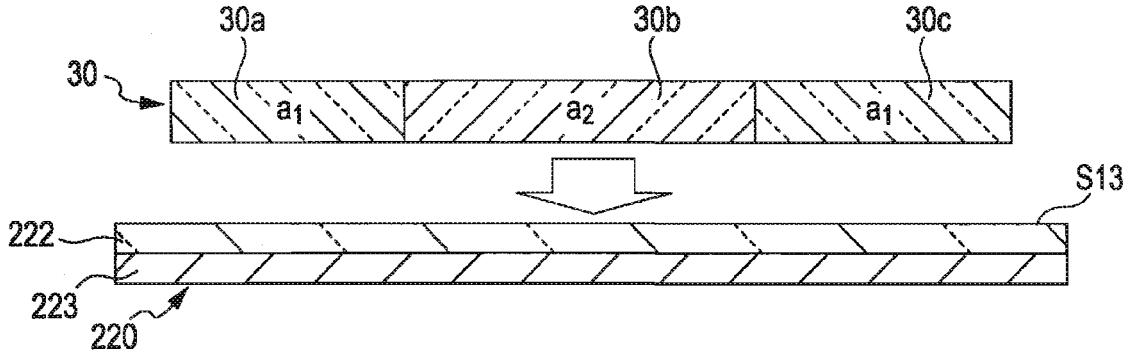
FIGS. 31A and 31B are explanatory views illustrating process steps of a manufacturing method of the electro-optical device according to one example.
Figure 31B:
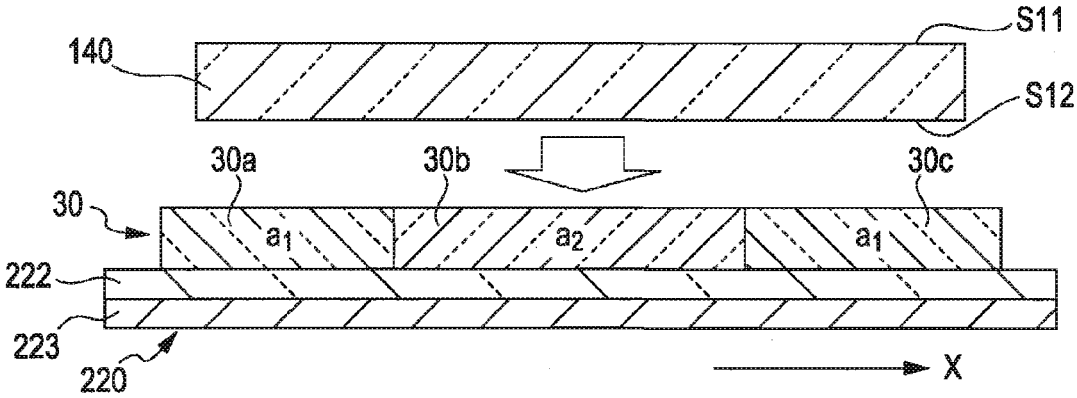

Next, as shown in FIG. 31A, the light transmissible member 30 is joined to the light-emitting panel 220. This joining is conducted in a manner such that the overall area of a widest surface (the lower surface in FIG. 31A) of a first side of the light transmissible member 30 is in contact with the light exit surface S13 of the light-emitting panel 220, the overall area of a region of the light-emitting panel 220, in which the light-emitting elements 221 are formed, overlaps the widest surface on the first side, and the lengthwise direction of the light transmissible member 30 and the arrangement direction of the light-emitting elements 221 accord with each other. In a subsequent step, as shown in FIG. 31B, the converging lens array 140 is joined to a widest surface on a second side (the upper surface in FIG. 31B, which is farther from the light-emitting panel 220 than the first widest surface) of the light transmissible member 30. This joining is conducted in a manner such that the overall area of the light incidence surface S12 of the converging lens array 140 is in contact with the widest surface on the second side of the light transmissible member 30, the arrangement direction (X direction) of the refractive index distribution type lenses 141 of the converging lens array 140 accords with the lengthwise direction of the light transmissible member 30, and the refractive index distribution type lenses 141 overlap a region of the light-emitting panel 220, in which the light-emitting elements 221 are formed.

Finally, the relational positions of the light-emitting panel 220, the light transmissible member 30, and the converging lens array 140 are fixed. The relational positions are arbitrarily determined. That is, the side surfaces (upper and lower surfaces) of the light transmissible member 30 may be in contact with the light-emitting panel 220 and the converging lens array 140. Alternatively, the light-emitting panel 220, the light transmissible member 30, and the converging lens array 140 may be received in a casing provided in order to attach the light-emitting panel 220 and the converging lens array 140 to the light transmissible member 30.

Second Manufacturing Method of Fifth Embodiment

In a second method, manufacturing method of the light-emitting panel 220 and measurement of the brightness unevenness are the same as in the first manufacturing method. Further, the point that the light transmissible member 30 has a light transmissible profile determined on the basis of the measurement is common in the first and second methods. Moreover, it is also common in the first and second methods that the light transmissible member 30 is realized by a single layer and the light transmissible member 30 is divided into a plurality of portions in the lengthwise direction, in which dimensions (length) and light transmittances of the portions are determined as in the first method. In the second method, a middle portion 30*b* is made of a light transmissible material having a light transmittance of a2. The light transmissible member 30 may be manufactured by directly putting the light transmissible material on the light-emitting panel 220, or by putting the middle portion 30*b* pre-manufactured in a discrete form on the light-emitting panel 220.

Figure 32A:
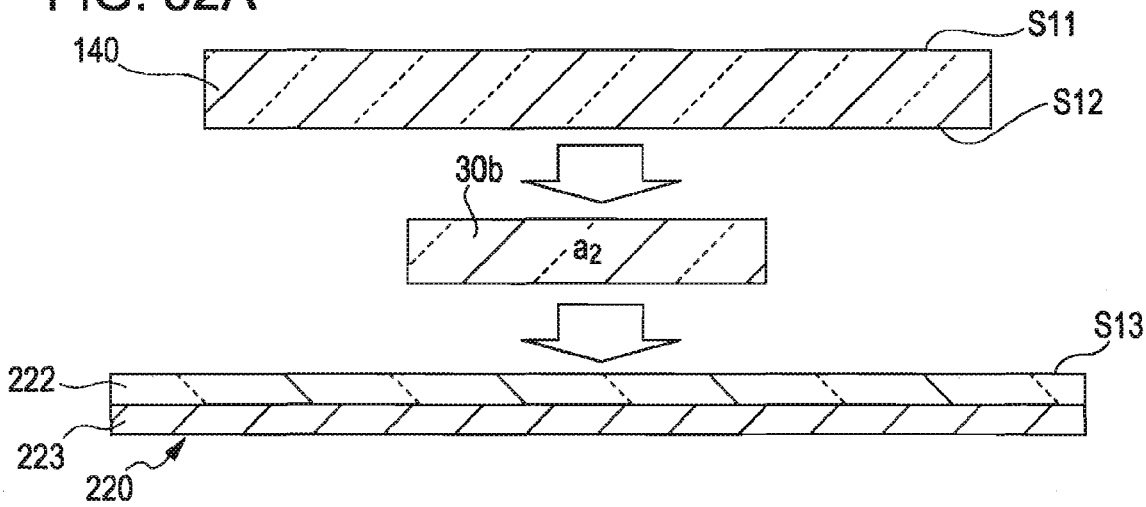
FIGS. 32A and 32B are explanatory views illustrating process steps of a manufacturing method of the electro-optical device according to another example.
Figure 32B:
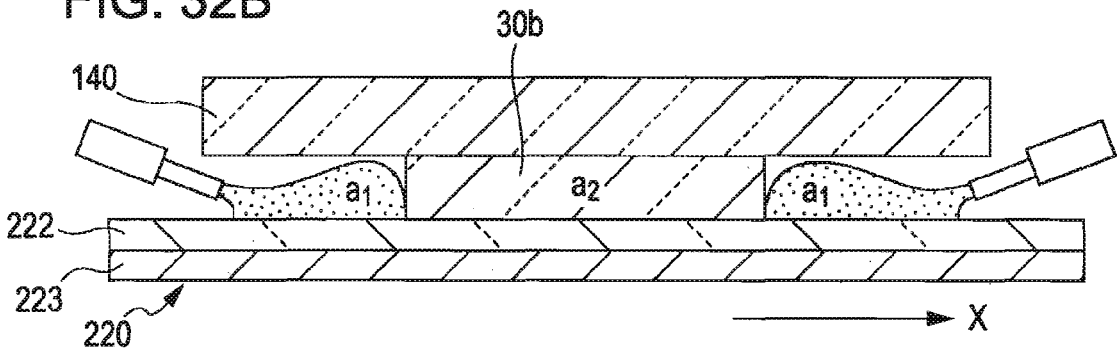

FIG. 32A shows the latter case. That is, the middle portion 30*b* having the light transmittance of a2 and a parallelepiped shape is placed on the light-emitting panel 330, and then the converging lens array 140 is disposed on the middle portion 30*a* and the light-emitting panel 220. The middle portion 30*a*, the light-emitting panel 220, and the converging lens array 140 are joined to each other in a state in which they are in tight contact with each other. Next, as shown in FIG. 32B, a transparent light transmissible material which can also function as an adhesive is injected into gaps provided at both sides of the middle portion 30*b* and defined by the light-emitting panel 220 and the converging lens array 140. The infected transparent light transmissible material is cured so as to form light transmissible portions 30*a* and 30*c*. In addition, a guide frame may be used in order to prevent the light transmissible material in a fluid form from leaking and obtain the light transmissible portions having a desired form.

Sixth Embodiment

Hereinafter, an electro-optical device according to a sixth embodiment will be described. In the electro-optical device 1D according to the sixth embodiment, a light transmissible has a stacked structure in which a plurality of layers is stacked in an optical direction of each lens. At least one layer of the plurality of layers, for example two layers according to this embodiment, have different right transmittance from other layers. The sixth embodiment will be described mainly with reference to different points from the fifth embodiment.

Figure 33:
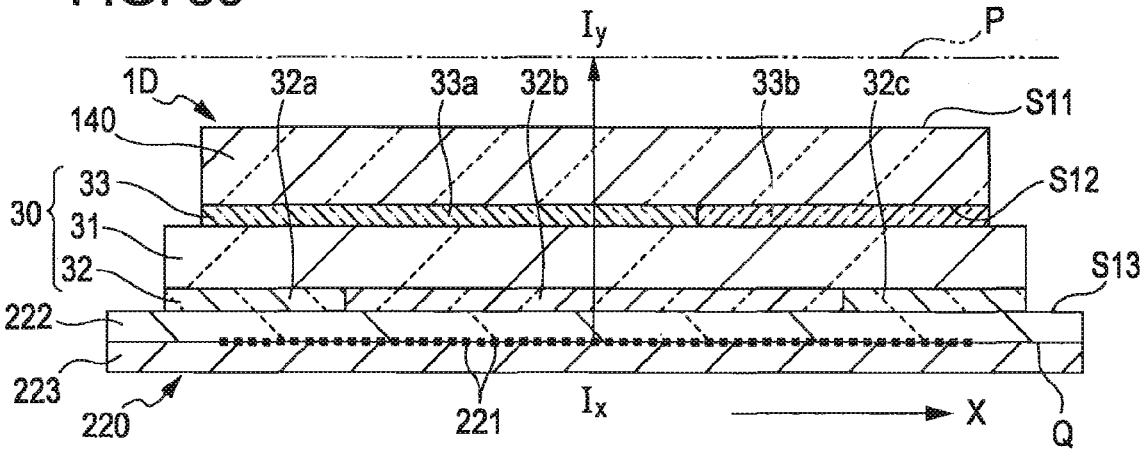
FIG. 33 is a side view illustrating an electro-optical device according to a sixth embodiment.

FIG. 33 is a side view (elevation view) illustrating the electro-optical device according to the sixth embodiment. The electro-optical device 1D according to the sixth embodiment is different from the fifth embodiment in that the light transmissible member 30 includes a plurality of layers shown the light transmissible member in the fifth embodiment shown in FIG. 29 includes only a single layer. The light transmissible member 30 shown in FIG. 33 includes three layers 31 to 33. The light transmissible member 30 functions as a member for maintaining a distance between the light-emitting panel 220 and the converging lens array 140 uniform by being disposed between the light-emitting panel 220 and the converging lens array 140. The light transmissible member 30 includes the plurality of layers 31 to 33 extending in a direction intersecting an optical axis of each refractive index distribution type lens 141.

The layer 31 is a middle layer having a uniform thickness which is interposed between the layers 32 and 33. According to this embodiment, the layer 31 is made of glass or transparent plastic, and light transmittance of the layer 31 is uniform over the entire length thereof. The entire surface of the layer 31 which is near an electro-optical panel 220 is in contact with the entire surface of the layer 32 which is near a converging lens array 140. The entire surface of the layer 31 which is near the converging lens array 140 is in contact with the entire surface of the layer 33 which is near the light-emitting panel 22.

The layer 32 is a layer interposed between the light-emitting panel 220 and the layer 31. The layer 32 has a function of an adhesive and a uniform thickness. The layer 32 includes a plurality of portions 32*a* to 32*c*, each having a rectangular parallelepiped shape, continuously connected in X direction. The portion 32*b* is made of a transparent light transmissible material which can function as an adhesive and has a light transmittance of a5. The portions 32*a* and 32*c* is made of a transparent light transmissible material which can function as an adhesive and has a light transmittance of a4.

The layer 33 is interposed between the layer 31 and the converging lens array 140 and has a uniform thickness. The layer 33 includes a plurality of portions 33*a*, 33*b*, and 33*c*, each portion having a rectangular parallelepiped shape. The portions 33*a*, 33*b*, and 33*c* extend in a continuous manner in X direction. The portion 33*a* is made of a transparent light transmissible material capable of functioning as an adhesive and having a light transmittance of a6. The portion 33*b* is made of a transparent light transmissible material capable of functioning as an adhesive and having a light transmittance of a7.

Length in X direction and light transmittances of the portions 32*a*, 32*b*, 32*c*, 33*a*, 33*b*, and 33*c* of the layer 32 and the layer 33 are properly set so as to offset the brightness of the plurality of light-emitting elements 221 or the combined brightness of the plurality of light-emitting elements 221 and the converging lens array 140 as in the previously mentioned embodiments. Accordingly, the brightness of light is almost uniform in X direction in the case in which the light-emitting panel 220, the light transmissible member 30, and the converging lens array 140 are assembled in a manner shown in FIG. 33.

The relationship between the brightness of light emitted from the light-emitting elements 221 and the brightness of light imaged on a imaging surface will be described. In FIG. 33, when the brightness of light which is emitted with the brightness of $I_x$ from the light-emitting element 221, passes the element substrate 222, the light transmissible member 30 constituted by the plurality of layers, and the converging lens array 140, and then imaged on the imaging surface is defined as $I_Y$, the brightness IY can be expressed by Expression 5.

$$I_y = s \cdot I_x \cdot \prod_{j=1}^{n} i_j \tag{5}$$

In Expression 5, $i_j$ is a light transmittance of the member through the light from the light-emitting elements 221 travels, $$\prod_{j=1}^{n} i_j$$

is the product of light transmittances of the members through which the light from the light-emitting elements 221 sequentially travels, and s is the efficiency of light utilization of the converging lens array. The light transmittance ij in Expression can be expressed by Expression 6:

$$i_j = e^{-\alpha t} \tag{6}$$

In Expression 6, $\alpha$ is a absorption coefficient and the eigenvalue of a material, t is a thickness of the material. In Expression 6, $\alpha$ can be expressed by Expression 7:

$$\alpha = 4\Pi k \cdot \lambda^{-1} \tag{7}$$

In Expression 7, k is an extinction coefficient and the eigenvalue of a material, and X is a wavelength.

In this embodiment, the light transmissible member 30 has different light transmittances according to positions by using the layers 32 and 33. Thanks to the structure, the brightness $I_Y$ of the light imaged on the imaging surface after emitted from all of the light-emitting elements 221 is uniform over the entire imaging surface. Accordingly, even in the case in which the brightness of the light emitted from the light-emitting or the light passing out the converging lens array 140 is uneven, it is possible to regulate the brightness of the light, so that the brightness of the light arriving at the imaging surface becomes even in X direction.

As is clear from the above description, this embodiment also has the same advantages as the fifth embodiment. In the case in which the light transmissible member 30 is comprised of a plurality of layers 31 to 33, and each of two or more layers of the plurality of layers is divided into a plurality of portions having different light transmittances, a larger variety of light transmittances can be obtained, and thus it is possible to more precisely offset the brightness unevenness.

In the sixth embodiment, the distribution of light transmittances of the two layers 32 and 33 is controlled according to the brightness distribution of light which is emitted from the plurality of light-emitting elements 221 and or the brightness distribution of light emitted from the plurality of light-emitting elements 221 and then passed out the converging lens array 140. However, either one of the two layers 32 and 33, or three or more layers may have light transmittance distribution. In the case of diversifying light transmittances of the light transmissible member 30 according to the brightness distribution of the light passed out through the converging lens array 140 after emitted from the plurality of light-emitting elements 221, the brightness unevenness of the plurality of light-emitting elements 221 is offset by either of the layers, for example the layer 33, and the unevenness in brightness, light transmittances or optical absorptance of the converging lens array 140 can be offset by the other layer, for example the layer 32. Further, the number of the layers and the number of layers having divided portions are variable.

Manufacturing Method of Sixth Embodiment

Hereinafter, a manufacturing method of the electro-optical device 1D according to the sixth embodiment in which the light transmissible member 30 includes a plurality of layers will be described. There can be various methods of manufacturing the electro-optical device according to the sixth embodiment, but here one exemplary method will be described below.

First, the light-emitting panel 220 and the layer 31 are manufactured. The layer 31 is made of a light transmissible material, such as glass or transparent plastic and has a predetermined shape and size. The light transmissible material preferably has a light transmittance as high as possible so as not to deteriorate the brightness of light. In this embodiment, the light transmissible member 30 has a light transmittance of a3 which is constant over the entire length thereof.

Figure 34A:
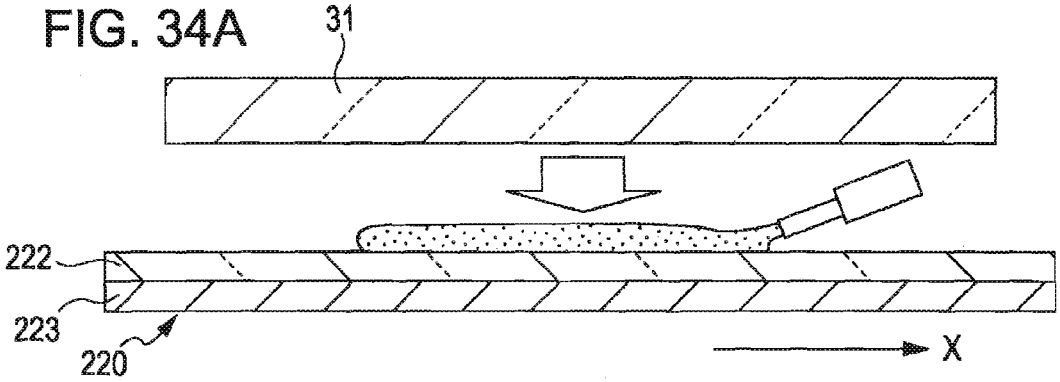
FIGS. 34A to 34D are explanatory views illustrating process steps of a manufacturing method of the electro-optical device.
Figure 34B:
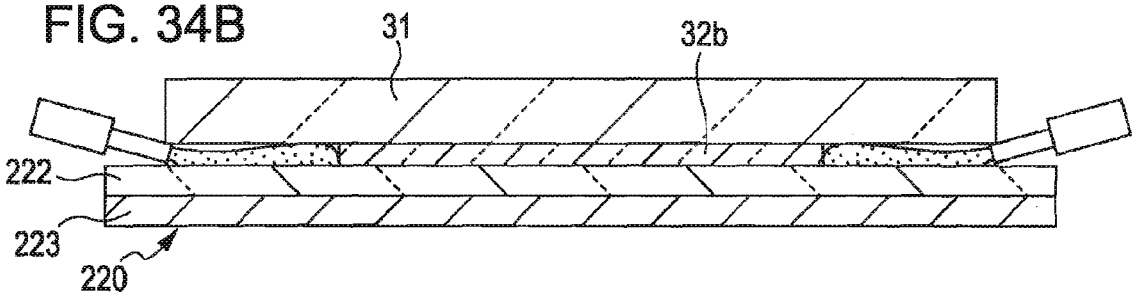
Figure 34C:
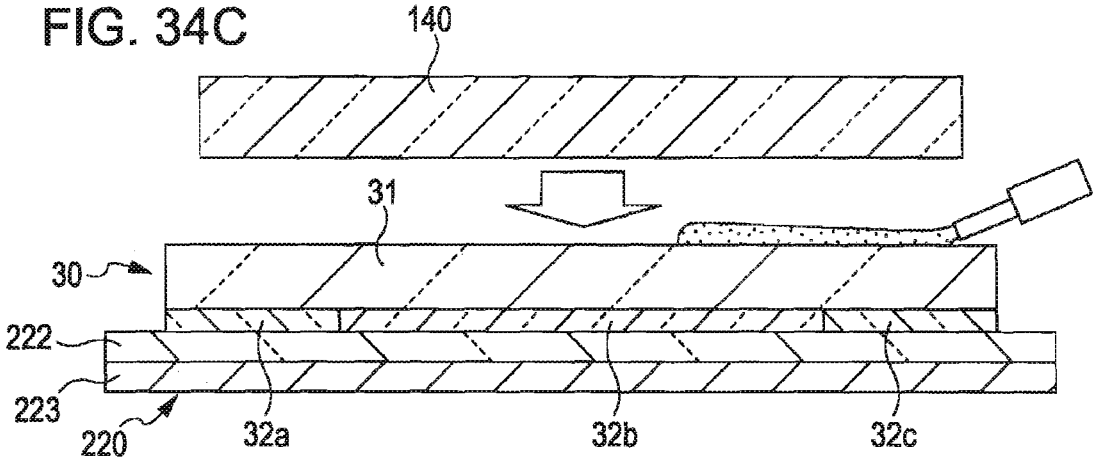

Accordingly, as shown in FIG. 34A, of the light exit surface S13 of the light-emitting panel 220, a transparent material which also functions as an adhesive and has a light transmittance of $a_5$ which is a light transmittance after curing is coated at a position in which the portion 32 is disposed. The light transmissible material is interposed between the light-emitting panel 220 and the layer 31, and then compressed until the light transmissible material has a predetermined thickness. When the light transmissible material is compressed to the predetermined thickness, the light transmissible material is cured so as to form the portion 32*b*, as shown in FIG. 34B and the light-emitting panel 220 and the layer 31 are jointed to each other by the portion 32*b*. Next, as shown in FIG. 34B, a transparent light transmissible material which can function as an adhesive is injected into gaps defined by the light-emitting panel 220 and the layer 31 and at both sides of the portion 32*b* and then cured so as to form the portions 32*a* and 32*c*, as shown in FIG. 34C. The transparent light transmissible material used for forming the portions 32*a* and 32*c* has a light transmittance of $a_4$.

Figure 34D:
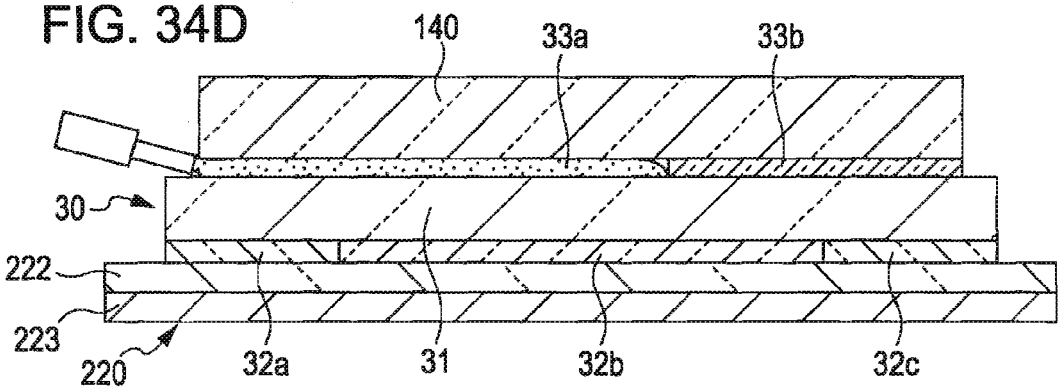

Next, as shown in FIG. 34C, a transparent light transmissible material which can function as an adhesive is coated on the surface (the upper surface) of the layer 31 which is farther from the light-emitting panel 220. The light transmissible material has a light transmittance of $a_7$ which is a light transmittance after curing. The light transmissible material is disposed between the layer 31 and the lens array 140 and then compressed until the light transmissible material has a predetermined thickness. As the light transmissible material is cured, as shown in FIG. 34D, the portion 33*b* is formed, and the layer 31 and the converging lens array 140 are joined to each other by the portion 33*b*. Next, a transparent light transmissible material having a light transmittance of $a_6$ which is a light transmittance after curing is injected into gaps defined by the layer 31 and the converging lens array 140 at both sides of the portion 33*b*, and then cured so as to form the portion 33*a*.

In the process of coating or injecting the light transmissible material having an adhesive function, a guide frame may be used in order to prevent the light transmissible material which is a fluid before curing from leaking and make the portions have a desired form. In addition, at the time of forming the portions by compressing the light transmissible material, a gap securing member may be used in order to make the portion have a uniform thickness with high precision. The gap securing member may have a ball shape having a predetermined diameter, or the like. The gap securing member may be present between the components for compressing the light transmissible material or may be mixed with the light transmissible material. It is preferable that the gap securing member is light transmissible and has a light transmittance almost equal to that of the above-mentioned light transmissible material.

By the above method, the light transmissible member 30 including the plurality of layers 31 to 33 can be interposed between the light-emitting panel 220 and the converging lens array 140. Thus, it is possible to easily manufacture the electro-optical device shown in FIG. 33 in a simple manner. As described above, the number of the layers of the light transmissible member 30, the number of layers having different light transmittances from each other, arrangement of the portions in the layer of the light transmissible member 30 may vary. Moreover, the manufacturing method also may be properly modified.

In the fifth embodiment and sixth embodiment, it is exemplified that the bottom emission type light-emitting panel 220 in which light from each light-emitting element 221 exits from the light-emitting panel 220 after passing through the element substrate 222. However, top emission type light-emitting panel in which light travels in reverse direction with respect to the bottom emission type light-emitting panel 220 can be also used. Further, an object through the light emitted from the plurality of electro-optical elements (light-emitting elements) pass may be a sealing member 223. In this case, each portion of the sealing member is made of a light transmissible material so as not to block the light emitted from each light-emitting element and directing to side portions thereof.

In the above-mentioned fifth and sixth embodiments, organic EL elements which need excitation base don carrier recombination are used as the plurality of light-emitting elements, in which light-emitting characteristic or light transmittance changes according to applied electric energy. However, light-emitting elements with no carrier combination, such as inorganic EL elements, light-emitting elements with no excitation, such as inorganic LED, or light valves in which the light transmittance change applied electric energy, such as liquid crystal elements may used.

Image Forming Apparatus

The electro-optical devices according to the embodiments can be used as a line-type optical head which forms a latent image on an image carrier in a photographic image forming apparatus. The image forming apparatus includes a printer, a printing portion of a copying machine, and a printing portion of a facsimile.

Figure 35:
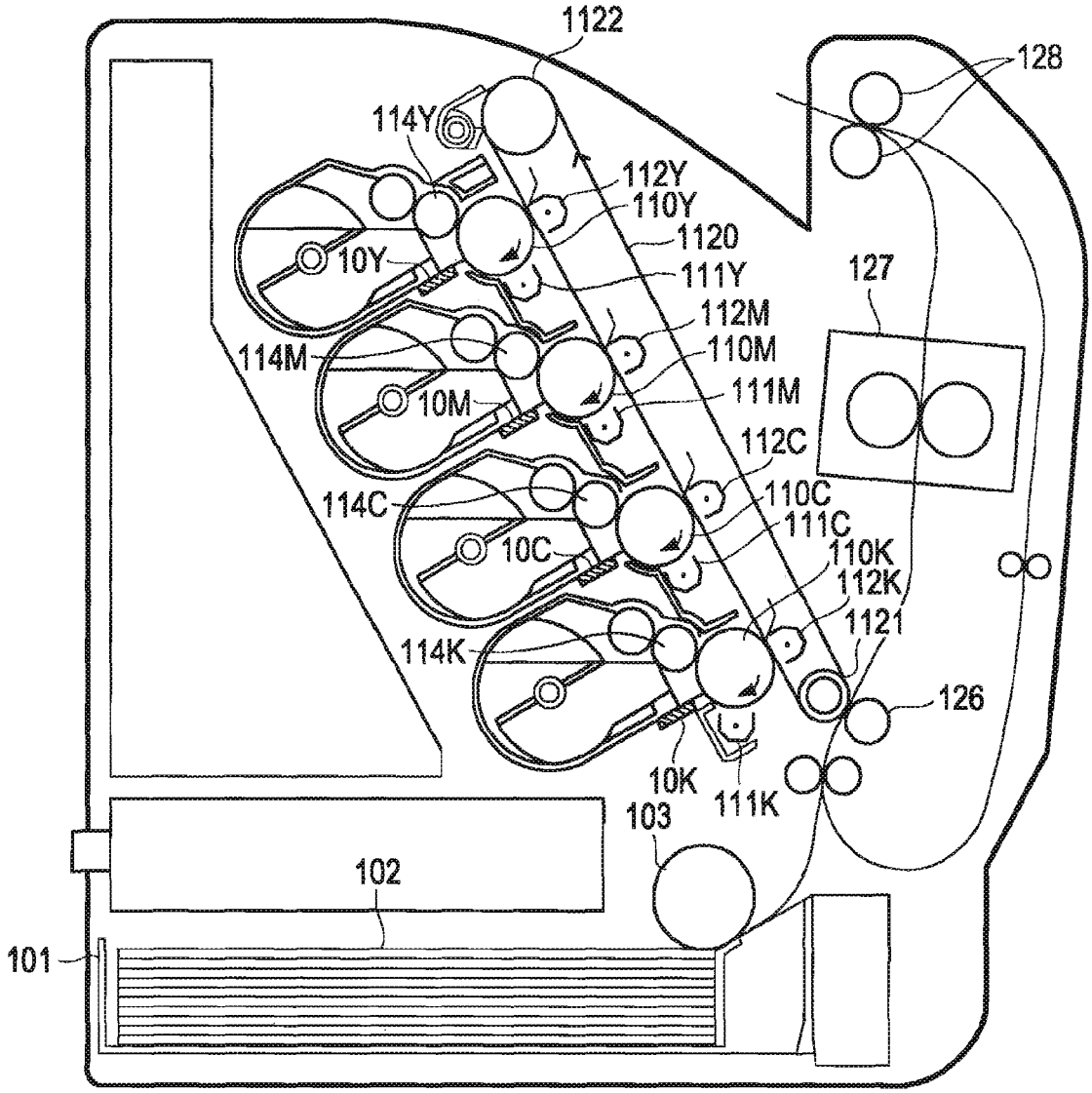
FIG. 35 is a cross-sectional view illustrating an image forming apparatus according to one embodiment.

FIG. 35 is a cross-sectional view illustrating the image forming apparatus according to one embodiment. The image forming apparatus is a tandem-type full color image forming apparatus using a belt intermediate transfer scheme. In this image forming apparatus, four optical heads 10*k*, 10C, 10M, 10Y having the same structure as each other are arranged at exposed positions on four photoconductor drums (image carriers) 110K, 110 C, 110 M, and 110 Y having the same structure as each other. The optical heads 10K, 10*c*, 10M, and 10Y are an electro-optical device according to any of the embodiments.

As shown in FIG. 35, the image forming apparatus includes a driving roller 1121 and a driven roller 1122. The rollers 1121 and 1122 are wound by an endless-type intermediate transfer belt 1120, and the transfer belt 1120 moves around the rollers 1121 and 1122 in a direction of an arrow. Although not shown, a tension imparting unit, such as a tension roller imparting tension to the intermediate transfer belt 1120 may be included.

The photoconductor drum 110K, 110C, 110M and 110Y having a photosensitive layer are arranged around the intermediate transfer belt 1120 with a predetermined interval therebetween. Symbols K, C, M, Y reference Y (for yellow), M (for magenta), C (for Cyan), and K (for black), respectively. The photoconductor drums 110K, 110C, 110M, 110Y are driven in synchronization with the intermediate transfer belt 1120.

Corona chargers 111K, 111C, 111M, and 111Y, and the optical heads 10K, 10C, 10M, and 10Y are installed around the corresponding photoconductor drums 110K, 110C, 110M, and 110Y. The corona chargers 111K, 111C, 111M, and 111Y charges the outer surface of the corresponding photoconductor drums 110K, 110C, 110M, and 110Y at uniform state. The optical heads 10K, 10C, 10M, and 10Y form latent images on the outer circumferential surfaces of the corresponding photoconductor drums 110K, 110C, 110M, and 110Y. The optical heads 10K, 10C, 10M, and 10Y are arranged in a manner such that the arrangement direction in of a plurality of EL elements 121 in each of the optical heads 10K, 10C, 10M, and 10Y accords with a main scan direction of each of the photoconductor drums 110K, 110C, 110M, and 110Y. Recording of the latent image is carried out when the plurality of EL elements 12 irradiate light on the photoconductor drum. Developers 114K, 114C, 114M, and 114Y develops the latent images by fixing toner onto the latent images so as to form visible images on the corresponding photoconductor drums 110K, 110C, 110M, and 110Y.

The black, cyan, magenta and yellow visible images formed by four single-color developing stations are sequentially transferred on the intermediate transfer belt 1120 so that the visible images overlap each other and thus a full color image is formed. Inside the intermediate transfer belt 1120 is provided four primary transfer corotrons 112K, 112C, 112M, and 112Y. The primary transfer corotrons 112K, 112C, 112M, and 112Y are arranged near the corresponding photoconductor drums 110K, 110C, 110M, and 110Y and transfer the visible images to the intermediate transfer belt 1120 moving between the photoconductor drums 110K, 110C, 110M, and 110Y and the primary corotrons 112K, 112C, 112M, and 112Y by elastically drawing the visible images from the corresponding photoconductor drums 110K, 110C, 110M, and 110Y.

A final image forming sheet 102 which is an object on which a final image is recorded is transported from a paper feeding cassette 101 by a pick-up roller 103 a sheet by a sheet and is sent to a nipple between the intermediate transfer belt 1120 near the driving roller 1121 and a secondary transfer roller 126. The full color visible image on the intermediate transfer belt 1120 is secondarily transferred to a face of the sheet 102 by the secondary transfer roller 126 at a time and then passes through a pair of fixing rollers 127 which is a fixing unit, so that the full color visible image is finally fixed on the sheet 102. Then, the sheet 102 is discharged to a discharge cassette disposed on an upper position of the image forming apparatus by a pair of discharge rollers.

Figure 36:
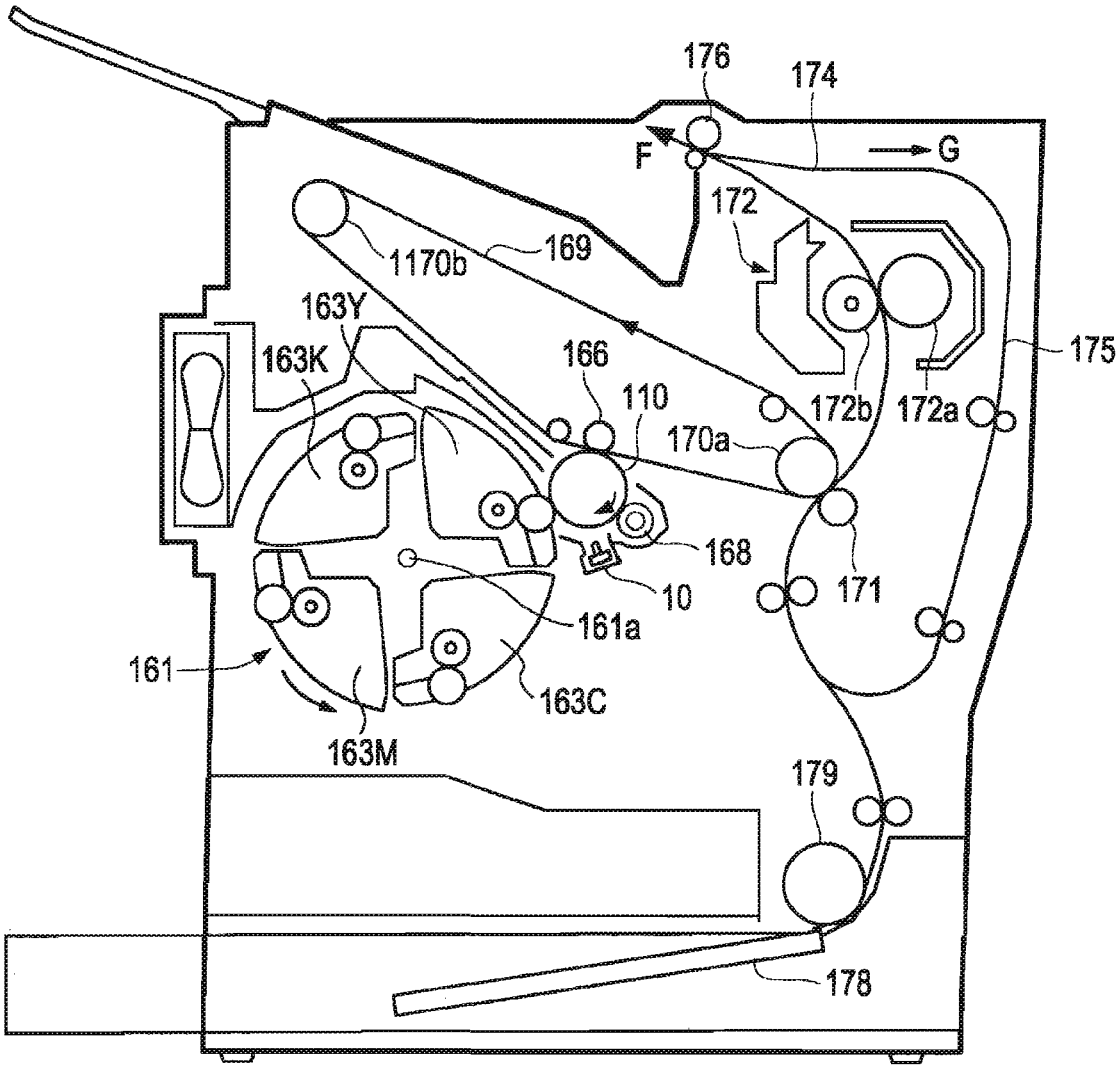
FIG. 36 is a cross-sectional view illustrating an image forming apparatus according to another embodiment.

FIG. 36 is a cross-sectional view illustrating further image forming apparatus relating to the embodiment of the invention. This image forming apparatus is a full color image forming apparatus based on a rotary developing scheme using a belt intermediate transfer body. In the image forming apparatus shown in FIG. 36, corona chargers 168, a rotary-type developing unit 161, an optical head 167, and an intermediate transfer belt 169 are provided around the photoconductor drum (image carrier). The optical head 167 is the electro-optical device according to the embodiment of the invention.

The corona charger 168 charges the outer surface of the photoconductor drum 165 at a uniform state. The optical head 167 writes a latent image on the charged outer surface of the photoconductor drum 165. The optical head 167 is the electro-optical device according to any of the embodiments or the electro-optical device according to any of modifications of the embodiments. Further, an arrangement direction of a plurality of EL elements 121 is the same as a main scan direction of the photoconductor drum 165. The writing of the latent image is conducted by irradiating light from the plurality of EL elements 121 on the photoconductor drum.

The developing unit 161 is a drum in which four developers 163Y, 163C, 163M, and 163K are arranged at an angle of 90°, and is rotatable in counterclockwise direction about a shaft 161*a*. The developers 163Y, 163C, 163M, and 163K forms visible images on the photoconductor drum 165 by supplying yellow, cyan, magenta, and black colors of toner to the photoconductor drum 165 and fixing the toner onto the latent images.

An endless-type intermediate transfer belt 169 is wound around a driving roller 1170*a*, a driven roller 1170*b*, a primary transfer roller 166, and a tension roller, and thus it moves around the driving roller 1170*a*, the driven roller 1170*b*, the primary transfer roller 166, and the tension roller in a direction of an arrow. The primary transfer roller 166 transfers the visible images to the intermediate transfer belt 169 moving between the photoconductor drum and the primary transfer roller 166 by elastically drawing the visible image from the photoconductor drum 165.

In greater detail, when the photoconductor drum 165 rotates first time, a latent image for a yellow (Y) image is recorded by the optical head 167, developed by the developer 163Y so as to produce a visible image in the corresponding color (yellow), and then transferred to the intermediate transfer belt 169. When the photoconductor drum 165 rotates second time, a latent image for a cyan (C) image is recorded by the optical head 167, developed by the developer 163C so as to produce a visible image in the corresponding cyan color, and transferred to the intermediate transfer belt 169 so as to overlap the yellow visible image. That is, while the photoconductor drum 169 rotates four times, a yellow visible image, a cyan visible image, a magenta visible image, and a black visible image are sequentially transferred to the intermediate transfer belt 169, so that a full color visible image is formed on the intermediate transfer belt 169. Finally, in the case in which the formed visible image is recorded on double sides of a sheet, one-color visible images are transferred to a front face and a back face of the intermediate transfer belt, respectively, and then another-color visible images are transferred to the front face and the back face of the intermediate transfer belt in the subsequent step. By repeating such steps, a full color visible image can be obtained from the in intermediate transfer belt.

The image forming apparatus is provided with a sheet transportation path through which a sheet passes. The sheet is picked up one by one by a pick-up roller 178 from a paper feeding cassette, then travels along the sheet transportation path 174 by aid of a transporting roller, and passes a nipple between the intermediate transfer belt 169 and a secondary transfer roller 171 disposed near the driving roller 1170*a*. The secondary transfer roller 171 transfers a visible image to a face of a sheet by elastically drawing the full color visible image from the intermediate transfer belt 169 at a time. The second transfer roller 171 is controlled by a clutch (not shown) so as to abuts to or be separated from the intermediate transfer roller 169. The secondary transfer roller 171 abuts to the intermediate transfer belt 169 when a full color visual image is transferred to a sheet, but is separated from the intermediate transfer belt 169 while primary image transfer to the intermediate transfer belt 169 is performed.

The sheet to which the visible image is transferred is transported to the fixing unit 172 and is forced to pass through a heating roller 172*a* and a compressing roller 172*b*. Though this process, the visible image is fixed on the sheet. The sheet after fixing moves to a pair of discharge rollers 176 and then advances in a direction of an arrow F. In the case of performing double-side printing, first the sheet travels forward through the pair of discharge rollers 176 until almost entire area of the sheet passes the pair of discharge roller 176, then the sheet travels backward in a direction of an arrow G by the reverse rotation of the pair of discharge rollers 176, and advances to the double-side printing transportation path 175. After that, the visible image is transferred to the other side of the sheet by the secondary transfer roller 171, the sheet undergoes the fixing process again, and the sheet is discharged through the pair of discharge rollers 176.

According to the above-mentioned image forming apparatuses, the optical head uses the electro-optical device according to the embodiments, it is possible to obtain high quality images.

Even though some image forming apparatuses using any of the electro-optical devices according to the embodiments are exemplified above, there may be a more variety of photographic image forming apparatuses to which any of the electro-optical devices according to the embodiments is applied, and such apparatuses are in the scope of the invention. For example, the electro-optical device according to any of the embodiments may be applied to an image forming apparatus capable of performing image transfer directly on a sheet from the photoconductor drum without using the intermediate transfer belt, or a single-color image forming apparatus.

The entire disclosure of Japanese Patent Application Nos. 2006-266420, filed Sep. 29, 2006, 2006-342296, filed Dec. 20, 2006 and 2007-83691, filed Mar. 28, 2007 are expressly incorporated by reference herein.

What is claimed is:

1. An electro-optical device, comprising:

a light source array having a plurality of light-emitting elements arranged in a direction;

a lens array having a plurality of lens elements arranged in the direction, each lens element forming an image on an image carrier using light from the light-emitting element; and a first light transmissible member and a second light transmissible member being interposed between the light source array and the lens array and being in contact with the light source array and the lens array, wherein the first light transmissible member and the second light transmissible member are arranged side by side in the direction and contact each other, and wherein the first light transmissible member and the second light transmissible member are different in any one or more characteristics of refractive index and light transmittance.

2. The electro-optical device according to claim 1, wherein the refractive index of the first light transmissible member is higher than that of the second light transmissible member, and wherein of light from the light-emitting elements, an imaging diameter of light imaged on the image carrier by passing through the first light transmissible member and the lens array is almost equal to an imaging diameter of light imaged on the image carrier by passing through the second light transmissible member and the lens array.

3. The electro-optical device according to claim 1, wherein the refractive index of the first light transmissible member is higher than that of the second light transmissible member, and wherein of light from the light-emitting elements, brightness of light which passed through the first light transmissible member and the lens array is almost equal to brightness of light passed through the second light transmissible member and the lens array.

4. An image forming apparatus, comprising:

an image carrier;

a charger for charging the image carrier;

the electro-optical device according to claim 1, which forms a latent image on a charged surface of the image carrier using light advancing from the light source array and passing out of the lens array;

a developer for forming a visible image on the image carrier by fixing toner to the latent image; and a transfer device for transferring the visible image from the image carrier to a predetermined medium.

* * * * *